US012605614B1

(12) United States Patent
Neubauer et al.

(10) Patent No.: US 12,605,614 B1
(45) Date of Patent: Apr. 21, 2026

(54) SHOULDER PAD SYSTEM WITH RIBBED EXTERNAL STIFFENING ARCH

(71) Applicant: VICIS IP, LLC, New York, NY (US)

(72) Inventors: Jason Neubauer, Sammamish, WA (US); Jose Santiago, Seattle, WA (US); Noah Lanphear, Seattle, WA (US)

(73) Assignee: VICIS IP, LLC, New York, NY (US)

( * ) Notice: Subject to any disclaimer, the term of this patent is extended or adjusted under 35 U.S.C. 154(b) by 0 days.

(21) Appl. No.: 18/882,567

(22) Filed: Sep. 11, 2024

Related U.S. Application Data

(60) Provisional application No. 63/581,883, filed on Sep. 11, 2023.

(51) Int. Cl.
*A63B 71/12* (2006.01)
*A63B 71/08* (2006.01)

(52) U.S. Cl.
CPC ..... *A63B 71/12* (2013.01)

(58) Field of Classification Search
CPC ..... A63B 71/12
See application file for complete search history.

(56) References Cited

U.S. PATENT DOCUMENTS 2,007,374 A * 7/1935 Kuehne ..... E04B 1/82 52/145
4,295,227 A * 10/1981 Mitchell ..... A63B 71/12 2/468
4,322,859 A * 4/1982 Mitchell ..... A63B 71/12 2/468
4,441,211 A * 4/1984 Donzis ..... A63B 71/12 2/463
4,467,475 A * 8/1984 Gregory ..... A63B 71/12 2/16
D328,159 S * 7/1992 Donzis ..... D29/100
5,159,715 A * 11/1992 Jurga ..... A63B 71/12 2/2.5
5,404,590 A * 4/1995 Monica, Jr. ..... A63B 71/1291 2/468
5,487,591 A * 1/1996 Knoblock ..... A47C 3/12 297/303.3
5,987,654 A * 11/1999 Chartrand ..... A63B 71/12 2/462
7,506,384 B2 * 3/2009 Ide ..... A63B 71/12 2/459
7,930,773 B2 4/2011 Ide et al.
8,549,674 B2 10/2013 Kraemer et al.
8,813,271 B2 8/2014 Kraemer et al.
9,132,334 B2 9/2015 Ide et al.
9,238,167 B2 1/2016 Monica
(Continued)

*Primary Examiner* — Robert H Muromoto, Jr.
(74) *Attorney, Agent, or Firm* — Ingrassia Fisher & Lorenz, LLP

(57) ABSTRACT

A shoulder pad system for protecting a wearer includes a first arch member and a second arch member that cooperatively define a neck opening for the wearer and that arch from a front side to a back side of the shoulder pad system. The shoulder pad system also includes an arch stiffener that arches and attaches over the first arch member. The arch stiffener includes a front edge disposed at the front side of the shoulder pad system and a back edge disposed at the back side of the shoulder pad system. The shoulder pad system also includes a stiffening rib that projects from and arches along the arch stiffener from the front edge to the back edge.

20 Claims, 14 Drawing Sheets

(56) References Cited

U.S. PATENT DOCUMENTS

| | | | | |
|---|---|---|---|---|
| 9,635,890 | B2 | 5/2017 | Monica | |
| 9,802,103 | B2 | 10/2017 | Monica | |
| 10,376,001 | B1 | 8/2019 | Williams et al. | |
| 10,517,336 | B2 | 12/2019 | Monica | |
| 11,089,826 | B2 | 8/2021 | Williams et al. | |
| 11,192,018 | B2 | 12/2021 | Monica | |
| 11,383,149 | B2 | 7/2022 | Monica | |
| 11,571,036 | B2 * | 2/2023 | Stone | A42B 3/065 |
| 11,712,072 | B2 | 8/2023 | Williams et al. | |
| 2006/0053535 | A1 * | 3/2006 | Ide | A63B 71/12 2/459 |
| 2007/0151004 | A1 | 7/2007 | Brassill | |
| 2017/0360124 | A1 | 12/2017 | Monica | |
| 2019/0145740 | A1 * | 5/2019 | Czerski | B32B 5/02 2/463 |
| 2020/0060374 | A1 * | 2/2020 | Glover | A42B 3/127 |
| 2021/0259350 | A1 * | 8/2021 | Neubauer | A42B 3/20 |
| 2023/0180860 | A1 | 6/2023 | Monica | |
| 2024/0032623 | A1 | 2/2024 | Williams et al. | |

* cited by examiner

SHOULDER PAD SYSTEM WITH RIBBED EXTERNAL STIFFENING ARCH

CROSS REFERENCE TO RELATED APPLICATIONS

The following claims priority to provisional patent application No. 63/581,883, filed Sep. 11, 2023, the entire disclosure of which is incorporated by reference.

TECHNICAL FIELD

Embodiments of the subject matter described herein relate generally to protective equipment of the type worn by sports participants. More particularly, embodiments of the subject matter described herein relate to a protective shoulder pad system of the type worn, for example, by football players, hockey players, lacrosse, and the like, the shoulder pad system including at least one ribbed external stiffening arch.

BACKGROUND

Shoulder pads are provided for various activities. For example, various shoulder pad configurations have been proposed for protecting wearers during sports activities (e.g., American football, hockey, lacrosse, etc.).

However, shoulder pads may suffer from various disadvantages. Some shoulder pads may be relatively heavy and/or bulky. Furthermore, some shoulder pads may be uncomfortable to wear and/or may be overly restrictive of the wearer's movement. Additionally, it may be difficult, inefficient, and expensive to manufacture some shoulder pads. Moreover, shoulder pads are typically limited when it comes to fitting, tailoring, and adjusting to a particular wearer (i.e., to the wearer's body, to the wearer's playing position, etc.).

Accordingly, it is desirable to provide a shoulder pad system that is lightweight and compact while also providing a high level of protection for the wearer. It is also desirable to provide shoulder pads that are less restrictive of the wearer's movement. Furthermore, it is desirable to provide shoulder pads that may be efficiently manufactured. Additionally, it is desirable to provide shoulder pads that are highly adjustable, modular, and able to be tailored to a number of different wearers. Other desirable features and characteristics will become apparent from the subsequent detailed description and the appended claims, taken in conjunction with the accompanying drawings and this background.

BRIEF SUMMARY

In an example embodiment, a shoulder pad system configured for protecting a wearer is disclosed. The shoulder pad system includes a first arch member and a second arch member that cooperatively define a neck opening for the wearer and that arch from a front side to a back side of the shoulder pad system. The shoulder pad system also includes an arch stiffener that arches and attaches over the first arch member. The arch stiffener includes a front edge disposed at the front side of the shoulder pad system and a back edge disposed at the back side of the shoulder pad system. The shoulder pad system also includes a stiffening rib that projects from and arches along the arch stiffener from the front edge to the back edge.

In another example embodiment, a method of manufacturing a shoulder pad system configured for protecting a wearer is disclosed. The method includes providing a first arch member configured to attach to a second arch member to cooperatively define a neck opening for the wearer. The first arch member arches from a front side to a back side of the shoulder pad system. The method also includes attaching an arch stiffener over the first arch member. The arch stiffener includes a front edge disposed at the front side of the shoulder pad system and a back edge disposed at the back side of the shoulder pad system. The arch stiffener includes a stiffening rib that projects from and arches along the arch stiffener from the front edge to the back edge.

In an additional embodiment, a shoulder pad system configured for protecting a wearer is disclosed. The shoulder pad system includes a first arch member and a second arch member that cooperatively define a neck opening for the wearer and that arch from a front side to a back side of the shoulder pad system. The shoulder pad system also includes a first arch stiffener that arches and attaches over the first arch member. The arch stiffener includes a first front edge disposed at the front side of the shoulder pad system and a first back edge disposed at the back side of the shoulder pad system. The first arch stiffener includes a first stiffening rib and a second stiffening rib that project from and arch along the first arch stiffener from the front edge to the back edge to increase stiffness of the first arch member. The shoulder pad system also includes an epaulette that is moveably coupled to the first arch stiffener for movement between a first position and a second position relative to the arch stiffener. Additionally, the shoulder pad system includes a shoulder cap that is configured to cover an outer shoulder area of the wearer and that is attached to the first arch stiffener.

BRIEF DESCRIPTION OF DRAWINGS

The various embodiments will hereinafter be described in conjunction with the following drawing figures, wherein like numerals denote like elements, and wherein.

DETAILED DESCRIPTION

Figure 1:
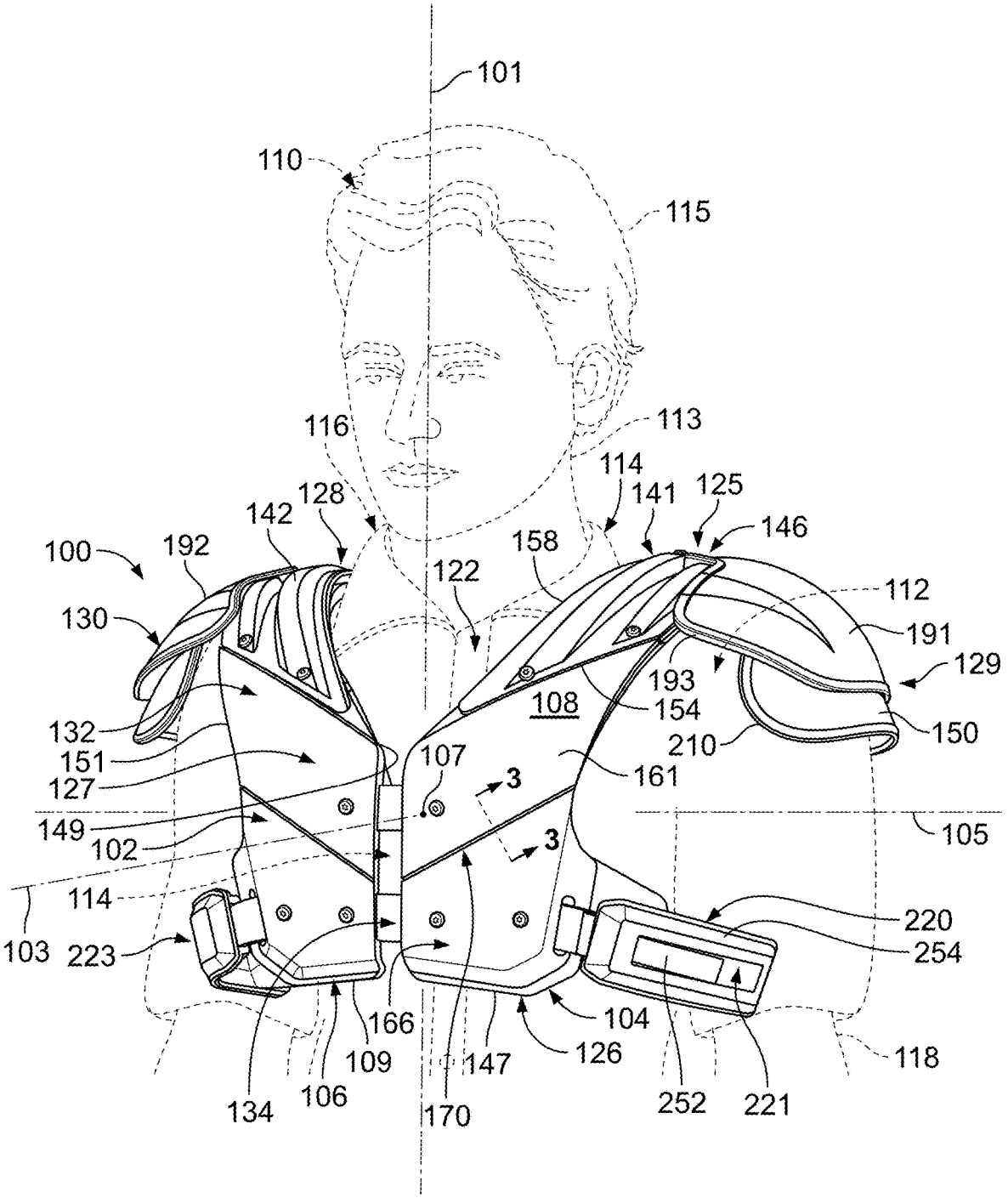
FIG. 1 is an isometric view of a shoulder pad system according to exemplary embodiments of the present disclosure.

The following detailed description is merely illustrative in nature and is not intended to limit the embodiments of the subject matter or the application and uses of such embodiments. As used herein, the word "exemplary" means "serving as an example, instance, or illustration." Any implementation described herein as exemplary is not necessarily to be construed as preferred or advantageous over other implementations. Furthermore, there is no intention to be bound by any expressed or implied theory presented in the preceding technical field, background, brief summary or the following detailed description.

Terminology may be used in the following description for the purpose of reference only, and thus are not intended to be limiting. For example, terms such as "upper", "lower", "above", and "below" refer to directions in the drawings to which reference is made. Terms such as "front", "back", "rear", "side", "outboard", and "inboard" describe the orientation and/or location of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second", and other such numerical terms referring to structures do not imply a sequence or order unless clearly indicated by the context. It should be understood that various aspects disclosed herein may be combined in different ways than the arrangements specifically presented in the description and accompanying drawings.

The present disclosure relates, generally, to a shoulder pad system. In exemplary embodiments, the shoulder pad system may be wearable protective gear for a sports activity, such as American football, hockey, lacrosse, and the like. The shoulder pad system may include various features providing a high degree of protection for the wearer while also being comfortable to wear, lightweight, and compact. The shoulder pad system may also advantageously provide a high degree of mobility for the wearer. Also, the shoulder pad system may be adaptable, modular, configurable, etc. such that the system may be tailored for a particular wearer (e.g., to fit according to the wearer's anatomy, etc.) and/or to adapt the shoulder pad system for a particular playing position. Additionally, the shoulder pad system may be manufactured efficiently.

For example, the shoulder pad system may include a first arch member and a second arch member that cooperatively define a neck opening for the wearer and that arch from a front side to a back side of the shoulder pad system. The shoulder pad system also includes a first arch stiffener that arches, layers, and attaches over the first arch member. The arch stiffener includes a first front edge disposed at the front side of the shoulder pad system and a first back edge disposed at the back side of the shoulder pad system. The first arch stiffener includes at least one stiffening rib that projects from and arches along the first arch stiffener from the front edge to the back edge to increase stiffness of the first arch member. The stiffener may also include a plurality of such stiffening ribs. The stiffener may provide support for an epaulette and/or a shoulder cap. The arch stiffener may improve performance of the shoulder pad system, provide improved protection, manufacturing efficiency, and/or may provide other benefits.

Figure 2:
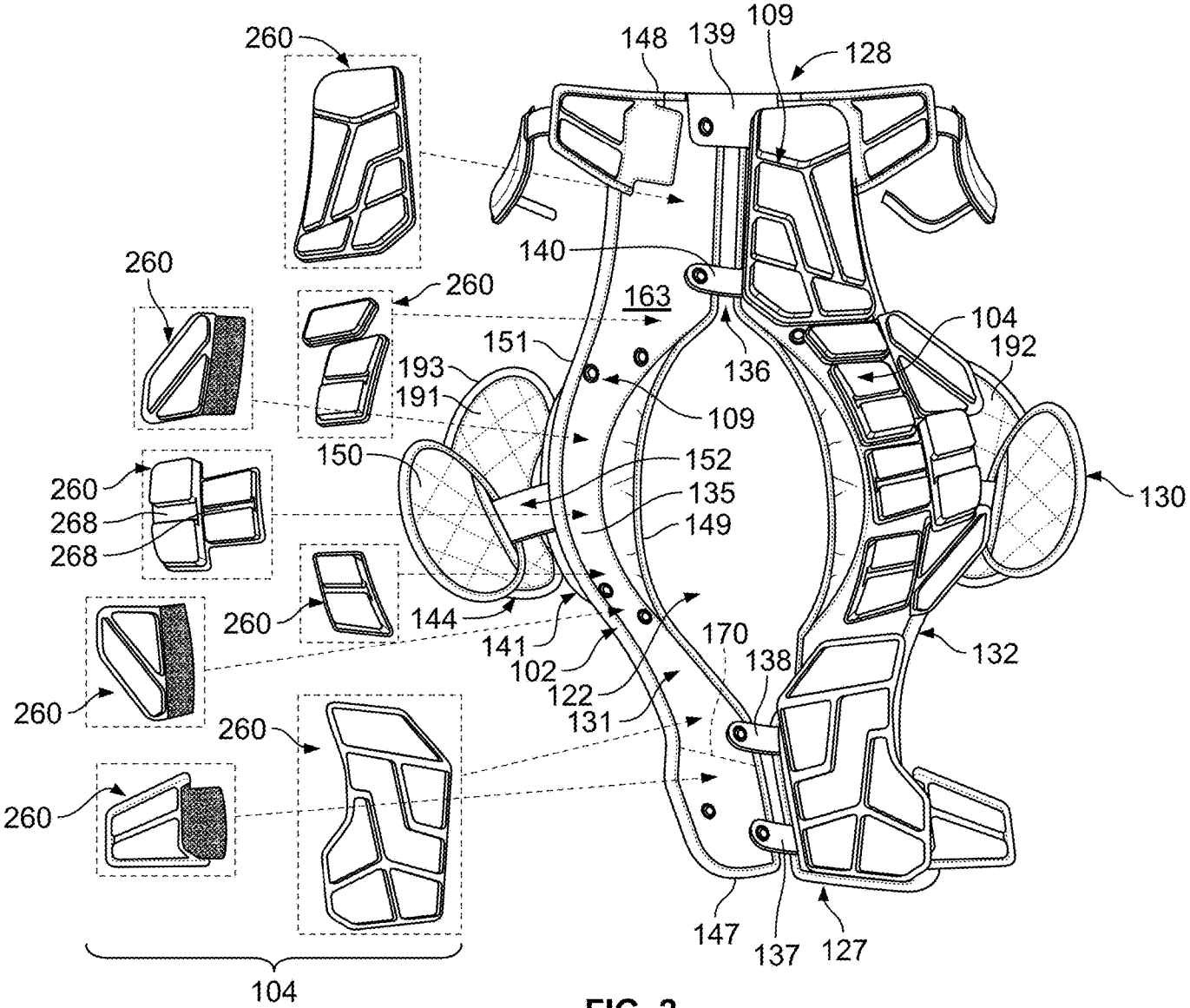
FIG. 2 is a bottom plan view of the shoulder pad system of FIG. 1 with components of a cushioning system shown exploded therefrom.

Referring to FIGS. 1 and 2, a shoulder pad system 100 is illustrated according to example embodiments of the present disclosure. The shoulder pad system 100 is shown worn by a wearer 110 that is shown in phantom. It will be appreciated that the shoulder pad system 100 may be configured for various activities, such as American football, hockey, lacrosse, or otherwise without departing from the scope of the present disclosure.

For reference purposes, features of the shoulder pad system 100 will be discussed relative to a Cartesian coordinate system (FIG. 1), which includes a first (vertical) axis 101, a second (sagittal) axis 103, and a third (frontal or lateral) axis 105 that intersect at a central point 107 within the shoulder pad system 100. The shoulder pad system may include a top end 125 and a bottom end 126, which are separated along the first axis 101. The shoulder pad system 100 may also include a front side 127 and a back side 128 that are separated along the second axis 103. The shoulder pad system 100 may also include a first lateral side 129 and a second lateral side 130 that are separated along the third axis 105. Also, the shoulder pad system 100 may include an outer side 108 (FIG. 1) that generally faces away from the central point 107 and the wearer 110 and an inner side 109 that faces opposite, i.e., generally toward the central point 107 and toward the wearer 110. It will be appreciated that these terms are used for reference when discussing the system 100 as a whole as well as discussing components of the system 100.

The shoulder pad system 100 may define a neck opening 122 that may receive a head 115 and neck area 113 of the wearer 110 such that the shoulder pad system 100 rests atop a left and right shoulder area 112 of the wearer 110. Also, when worn, the shoulder pad system 100 may cover over a chest area 114 and an upper back area 116 of the wearer 110.

Generally, the shoulder pad system 100 may include a protective outer covering 102. The protective outer covering 102 may include a plurality of strong, tough, somewhat stiff but resilient armor members 106 (e.g., pads, plate-like members, shield members, protective covering members) that are assembled to fit over and protect the shoulder area 112, the chest area 114, and the upper back area 116 of the wearer 110. The armor members 106 may be assembled together by various joints that will be discussed in detail below according to exemplary embodiments. The armor members 106 may also be somewhat resiliently flexible (e.g., under bending loads) as will be discussed for energy absorption, protection of the wearer 110, to adjust and fit to the wearer 110, etc. The protective outer covering 102 may also include some foam, padding, fabric covering, and/or other features as will be discussed. The protective outer covering 102 may be disposed generally on the exterior of the system 100 when worn and may substantially define the outer side 108 and, as such, may be referred to as a protective outer shell for the wearer 110.

The shoulder pad system 100 may also generally include a cushioning system 104 with various resilient pads, cushions, pillows, bladders, or other cushioning members that are attached to respective members of the protective outer covering 102. In FIG. 2, portions of the cushioning system 104 are exploded from the protective outer covering 102 and other portions of the cushioning system 104 are shown attached to the protective outer covering 102. When worn (FIG. 1), the cushioning system 104 may be layered between the protective outer covering 102 and the wearer 110 for protecting the wearer 110 against impact loads, for shock absorption, etc. The cushioning system 104 may be disposed generally on the interior of the system 100 when worn and may substantially define the inner side 109 and, as such, may be referred to as a protective inner cushion for the wearer 110.

Moreover, the shoulder pad system 100 may generally include various couplings, such as straps, belts, snaps, rivets, threaded fasteners, clamps, loop-and-pile tape, etc. These couplings may attach features of the shoulder pad system 100 together and/or to fit the shoulder pad system 100 to the wearer 110 as will be discussed in detail below. At least some of these couplings may be fixed couplings. At least some of these couplings may removably attach components together (i.e., move between an attached position and a detached position). At least some of these couplings may be adjustable between a first attached position and a second attached position, for example, to adjust the fit of the shoulder pad system 100, to re-configure the shoulder pad system 100, to adjust positioning of one or more components of the shoulder pad system 100 on the wearer 110, to tighten the shoulder pad system 100 on the wearer 110, and/or to loosen the shoulder pad system 100, etc.

The protective outer covering 102 will be discussed initially according to exemplary embodiments. The armor members 106 of the protective outer covering 102 may include a number of contoured sheet-like, plate-like, saddle-shaped, bowl-shaped, or other similar parts that are assembled together. The armor members 106 may be made from and/or include a strong, tough, and resiliently flexible thermoplastic, polymeric or composite material. In some embodiments, the outer covering 102 may define a majority of the outer side 108 of the shoulder pad system 100.

The protective outer covering 102 may include a first arch member 131 of the first lateral side 129. The first arch member 131 may be a large, elongate, contoured plate that resembles an inverted U-shape and that extends from the chest area 114, over the shoulder area 112, to the upper back area 116 of the wearer 110 on the left side of the head 115 of the wearer 110. The first arch member 131 may arch and curve over third axis 105 to cover the shoulder area 112 of the wearer 110. The protective outer covering 102 may further include a second arch member 132 of the second lateral side 130 that extends from the chest area 114, over the shoulder area 112, to the upper back area 116 of the wearer 110 on the right side of the head 115. The first arch member 131 and the second arch member may be symmetrical about a sagittal plane of the wearer 110.

The first arch member 131 is shown in detail in FIGS. 1 and 2 and specific features will be discussed according to exemplary embodiments. It will be appreciated that the second arch member 132 may include similar and corresponding features. As shown, the first arch member 131 may include a front bottom edge 147, a back bottom edge 148, an inner edge 149, and an outer edge 151. These edges 147, 148, 149, 151 (in combination with the corresponding edges of the second arch member 132) may define the majority of the outer profile of the shoulder pad system 100; therefore, these edges 147, 148, 149, 151 may be referred to as "terminal" or "outer" or "peripheral" edges of the shoulder pad system 100.

The first arch member 131 may arcuately contour from the front bottom edge 147 to the back bottom edge 148. When worn, the front bottom edge 147 may be positioned proximate the lower areas of the front ribcage of the wearer 110, and the back bottom edge 148 may be positioned proximate or below the shoulder blade of the wearer 110. The inner edge 149 may be disposed at the neck opening 122 proximate the axis 101, and the outer edge 151 may be disposed at the lateral side 129. Also, as shown in FIG. 1, the first arch member 131 may include an exterior surface 161 that faces outward to define part of the outer side 108 of the shoulder pad system 100, and the first arch member 131 may include an interior surface 163 that faces inwardly toward the wearer 110. The thickness of the first arch member 131 may be measured between the exterior surface 161 and the interior surface 163. The thickness may remain constant over some portions and other portions may have a different thickness (e.g., a reduced thickness area for increased flexibility).

Figure 3A:
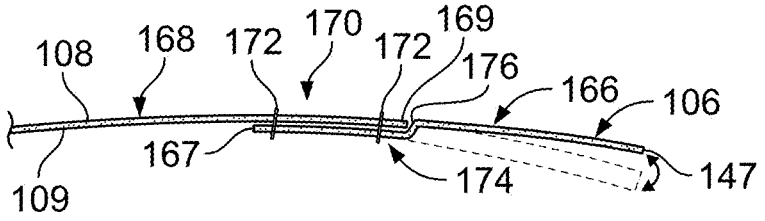
FIGS. 3A-3E are cross-sectional views of the shoulder pad system taken along the line 3-3 of FIG. 1 according to various exemplary embodiments of the present disclosure.

As shown in FIGS. 1 and 3A, the first arch member 131, on the front side 127, may comprise at least two separate, independent armor members 106, including a lower chest plate 166 and an arch body 168 that are moveably attached by a joint 170. The lower chest plate 166 may be a unitary, one-piece, plate-like armor member 106 that is slightly contoured and that defines the front bottom edge 147 of the first arch member 131. The lower chest plate 166 may also include a top edge 167 that is attached to a lower edge 169 of the arch body 168 at the joint 170. The arch body 168 may be a unitary, elongate armor member 106 that extends upward from the lower edge 169, arches over the shoulder area 112, and extends down the upper back area 116 of the wearer 110 to define the back bottom edge 148.

As shown in FIG. 3A, the lower chest plate 166 and the arch body 168 may be overlapped with the top edge 167 disposed higher on the shoulder pad system 100 (i.e., closer to the top end 125) and the lower edge 169 lower on the shoulder pad system 100 (i.e., closer to the bottom end 126). The joint 170 may include one or more fasteners 172, such as rivets, that extend through the overlapping areas of the lower chest plate 166 and the upper arch member. Also, at the joint 170, the lower chest plate 166 may include a stepped outer edge 174, which includes the top edge 167. The stepped outer edge 174 may underlie and receive the lower edge 169 such that other areas of the lower chest plate 166 adjacent the joint 170 are substantially flush with the arch body 168 and such that a narrow groove 176 is defined at the joint 170. Thus, the outer side 108 may appear substantially smooth, level, and continuous from the arch body 168, across the joint 170, to the lower chest plate 166 with the narrow groove 176 interrupting the transition.

As shown in FIG. 1, the groove 176 may be thin, substantially straight, and elongate. The groove 176 may extend from the outer edge 151, across the front side 127 of the shoulder pad system 100, to the inner edge 149. The groove 176 may be disposed at a bias angle across the front side 127 (relative to the lateral third axis 105) such that the groove 176 is higher (i.e., closer to the top end 125) at the outer edge 151 and the groove 176 is lower (i.e., closer to the bottom end 126) at the inner edge 149. The groove 176 may extend the entire length of the joint 170 such that the lower chest plate 166 is securely suspended from (i.e., tightly hung) from the upper chest plate member 180.

Figure 3B:
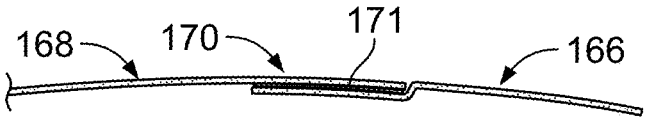

As shown in the embodiments of FIG. 3B, the joint 170 may be substantially similar to the embodiments of FIG. 3A. However, the lower chest plate 166 may be attached differently to the upper arch member. As shown, the lower chest plate 166 may be adhesively attached to the arch body 168 with an adhesive 171.

Figure 3C:
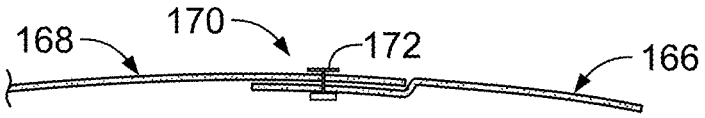

Referring to FIG. 3C, the joint 170 may be substantially similar to the embodiments of FIG. 3A. However, the lower chest plate 166 may be attached differently to the upper arch member. As shown, the joint 170 may include a fastener 172, such as a rivet, that is substantially centered within the joint 170.

Figure 3D:
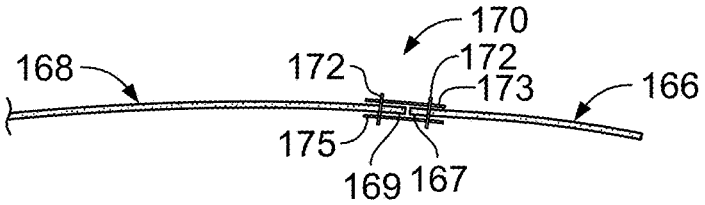

Now referring to FIG. 3D, the joint 170 may be substantially similar to the embodiments of FIG. 3A. However, the lower chest plate 166 may be attached differently to the upper arch member. As shown, the joint 170 may be a butt joint wherein the top edge 167 and the lower edge 169 butt together with an outer joint tape 173 covering over the edges 167, 169 on one side of the joint 170, and an inner joint tape 175 covering over the edges 167, 169 on the opposite side thereof. Also, the fasteners 172 (e.g., rivets, stitching, etc.) may extend through both the outer joint tape 173 and the inner joint tape 175 and either the lower edge 169 or the top edge 167. The joint tape 173, 175 may be made from fabric, polymeric material, or other flexible material.

Figure 3E:
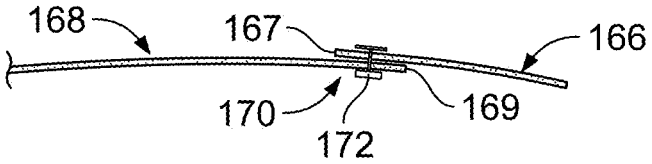

As shown in FIG. 3E, the joint 170 may be substantially similar to the embodiments of FIG. 3A. However, the top edge 167 of the lower chest plate 166 may overlap the lower edge 169 of the arch body 168 (i.e., without a step), and the fastener 172 may extend through the overlapping edges 167, 169.

The joint 170 (e.g., one of those illustrated in FIGS. 3A-3E) may be a flexible joint that provides predetermined flexure characteristics for the shoulder pad system 100. The groove 176 may define a hinge or pivot point across the front side 127 (i.e., across the chest area 114 of the wearer 110). Also, the overlapping edges 167, 169, and/or the different configurations of the joint 170 of FIGS. 3A-3E may be incorporated in the shoulder pad system 100 to provide the desired flexure characteristics. In some embodiments, the thickness, cross-section, or other features of the edges 167, 169 may be chosen to provide the predetermined flexure characteristics.

Also, in some embodiments, the lower chest plate 166 and the arch body 168 may have different flexibility. The lower chest plate 166 may be more flexible than the arch body 168 across the joint 170. The lower chest plate 166 may have lower thickness than the arch body 168, for example, to be more flexible. Also, in some embodiments, the lower chest plate 166 may be made from a more flexible material.

When fitting and tightening the shoulder pad system 100 to the body of the wearer 110, upon impact, or under another applied load, the lower chest plate 166 may rotate, fold, bend, or otherwise flex slightly. For example, FIG. 3A shows a neutral position of the joint 170 in solid lines and a flexed position in phantom lines. As shown, the lower chest plate 166 may resiliently flex, rotate, fold, bend, etc. at the joint 170, relative to the upper arch member. When the load is reduced, the lower chest plate 166 may resiliently recover and flex back to the neutral position shown in solid lines. Because of the groove 176 and/or other features of the joint 170, the shoulder pad system 100 may flex, deform, resiliently in a predetermined, controlled manner. The joint 170 may allow the shoulder pad system 100 to front side 127 to flex and fold at the bottom end 126 to closely conform and secure to the body of the wearer 110 for comfortable fit, high mobility, etc. These features may also increase protection for the wearer 110. The configurations of FIGS. 3B-3E may also flex resiliently and fold or pivot about the joint 170. The different configurations may flex different from each other, for example to provide a unique set of flex characteristics (e.g., different flexibilities, different flexure range, etc.). The joint 170 may be chosen to provide the desired flexure characteristics.

The second arch member 132 may be substantially similar and may include corresponding components to the first arch member 131. The first arch member 131 and the second arch member 132 may be joined on the front side 127 by a chest coupling 134 (FIGS. 1 and 2) and on the back side 128 by a back coupling 136 (FIG. 2). The first arch member 131 and the second arch member 132 may be attached to cooperatively define the neck opening 122.

It will be appreciated that the first and second arch members 131, 132 may be configured to be disposed relatively close to the body of the wearer 110 with the cushioning system 104 disposed therebetween. The first and second arch members 131, 132 may define a robust and strong core or protective outer shell for the shoulder pad system 100. The first and second arch members 131 may also provide resilient flexibility upon impact, which may provide energy absorption and further protection for the wearer 110. The first and second arch members 131, 132 may be closely contoured to fit comfortably and closely against the wearer 110. The first and second arch members 131, 132 may be lightweight and may provide the wearer 110 with high mobility and range of movement. Also, in some embodiments, the features of the first and second arch members 131, 132 may be adjustable to change size, fit, stiffness, or other characteristics.

Figure 4A:
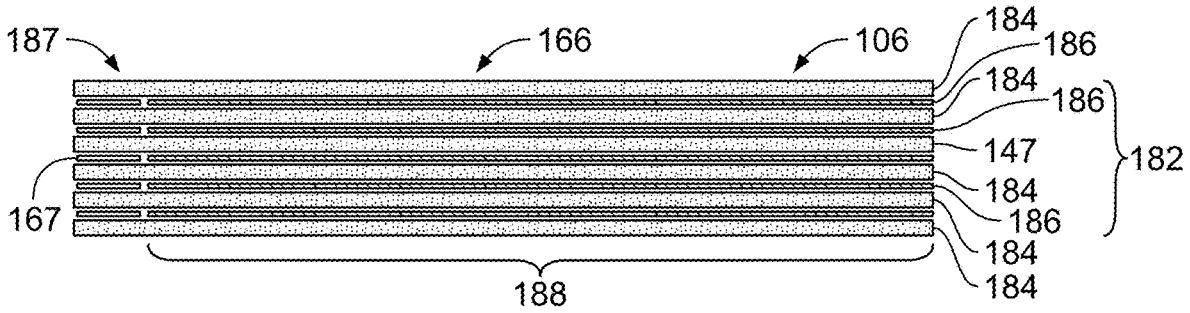
FIGS. 4A-4D are cross-sectional views of an armor member of the shoulder pad system of FIG. 1 according to various exemplary embodiments of the present disclosure.
Figure 4B:
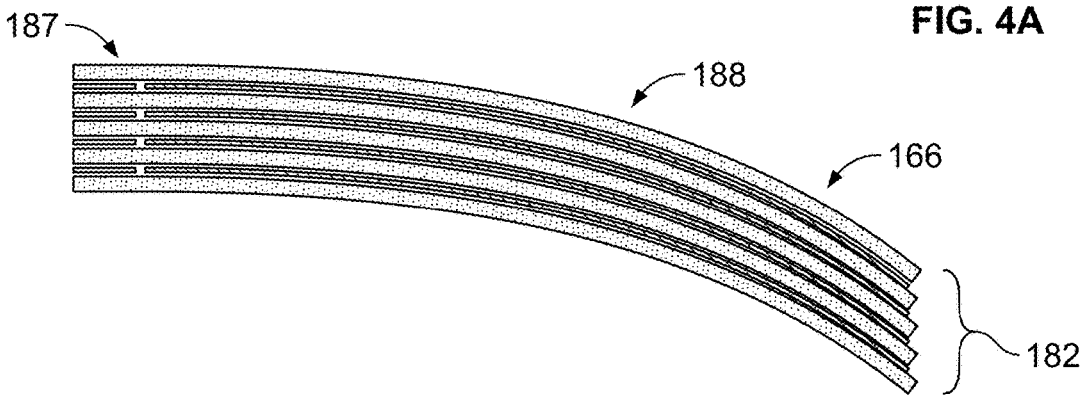
Figure 4C:
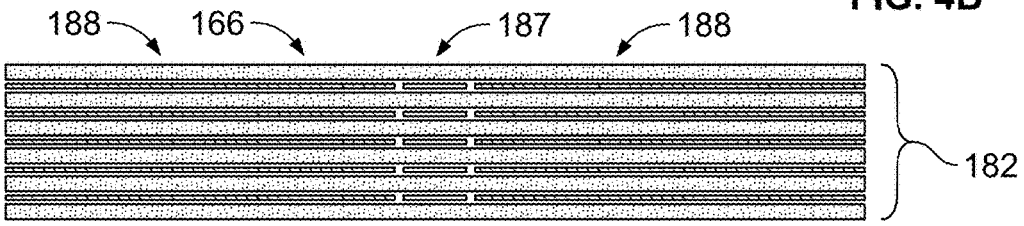
Figure 4D:
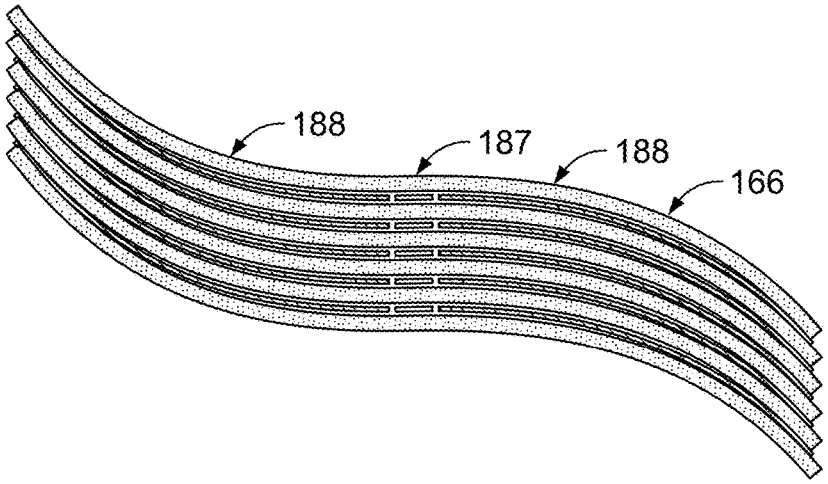

Additional embodiments of the lower chest plate 166 are illustrated in FIG. 4A. Instead of comprising a unitary, one-piece armor member 106 as in the embodiments of FIGS. 3A-3E, the lower chest plate 166 may comprise a plurality of layers 182, such as a plurality of first layers 184 interspersed with second layers 186. The first layers 184 may be formed of a high-strength, flexible sheets of polymeric material, and the second layers 186 may also be formed of a polymeric material with a low coefficient of friction. In other words, the first layers 184 may be stronger than the second layers 186, and the second layers 186 may have a lower coefficient of friction than the first layers 184. The plurality of layers 182 may be attached (e.g., by an adhesive, via one or more fasteners, etc.) at an attachment area 187. The layers 186 may also be detached at other detached areas 188. In some embodiments, the attached area 187 may be disposed at and/or may define the top edge 167 of the lower chest plate 166, and the detached area 188 may define the rest (i.e., may define the majority of the lower chest plate 166), including the front bottom edge 147. In other embodiments illustrated in FIG. 4C, the attached area 187 may be included centrally on the lower chest plate 166, and the edges 147, 167 may be defined by detached layers 182. FIG. 4A may represent the lower chest plate 166 in an unbiased, neutral position according to some embodiments, and FIG. 4B may represent the lower chest plate 166 in a flexed position. As shown, the layers 182 at the detached area 188 may shear, slide, shift, or otherwise displace over each other as they bend relative to the attached area 187. Likewise, as shown in FIG. 4D, the detached areas 188 may bend with the layers 182 shifting relative to each other and bending relative to the attached area 187. It will be appreciated that these features may be incorporated in other armor members 106 of the shoulder pad system 100. One or more features of FIGS. 4A-4D may be included in different protective, wearable gear without departing from the scope of the present disclosure. These features may provide resilient flexibility for energy absorption, for impact mitigation, for contouring against the body of the wearer 110, etc.

In some embodiments, the chest coupling 134 may include at least one strap, such as a first chest strap 137 and a second chest strap 138 (FIG. 2). The first chest strap 137 and the second chest strap 138 may be thin, elongate strips of material (e.g., polymeric or composite material) that are fixedly connected at one end to the first arch member 131 and at the opposite end to the second arch member 132 at the chest area 114 of the wearer 110. Likewise, the back coupling 136 may include at least one strap, such as a first back strap 139 and a second back strap 140. The first back strap 139 and the second back strap 140 may be short, thin, strips or bands of material (e.g., polymeric or composite material) that are fixedly connected at one end to the first arch member 131 and at the opposite end to the second arch member 132 at the upper back area 116 (e.g., between the shoulder blades) of the wearer 110. The first chest strap 137 and the second chest strap 138 may be spaced apart with the second chest strap 138 closer to the neck opening 122 than the first chest strap 137. The first chest strap 137 may be fixed at both ends to the lower chest plate 166 of the first and second arch members 131, 132. In one or more embodiments, the ends of the first chest strap 137 may be attached to the lower chest plate 166 of the first and second arch members 131, 132, below the respective joints 170, and the ends of the second chest strap 138 may be attached to the arch body 168 of the first and second arch members 131, 132, above the respective joints 170. Likewise, the first back strap 139 may be spaced apart from the second back strap 140 with the second back strap 140 closer to the neck opening 122 than the first back strap 139. In some embodiments, the first chest strap 137, the second chest strap 138, the first back strap 139, and the second back strap 140 may be attached to the arch members 131, 132 via rivets, via threaded fasteners, or other fasteners.

In some embodiments, the chest coupling 134 may define areas of different flexure characteristics between the first arch member 131 and the second arch member 132. For example, the second chest strap 138 may be more flexible (e.g., higher bending and/or buckling flexibility) than the first chest strap 137. Also, in some embodiments, the back coupling 136 may define areas of different flexure characteristics between the first arch member 131 and the second arch member 132. Furthermore, in some embodiments, the second chest strap 138 may be made of a more flexible material than the first chest strap 137 to provide the different flexibilities in the chest coupling 134. Also, in some embodiments, the first chest strap 137 and the second chest strap 138 may have different thicknesses to provide the different flexure characteristics. Likewise, the second back strap 140 may be thinner than the first back strap 139 and/or the second back strap 140 may be made of a different material from the first back strap 139 to provide the different flexure characteristics therebetween.

Thus, the chest coupling 134 may include a more rigid lower connection at the first chest strap 137 (i.e., further from the neck opening 122) and increased flexibility at the second chest strap 138 to allow buckling and pinching of the second chest strap 138, for example, as the wearer 110 raises one or both of their arms 118. Similarly, the back coupling 136 may be more rigid, less flexible, and/or less prone to buckling at the first back strap 139 as compared to the second back strap 140. Accordingly, the shoulder pad system 100 may allow for high mobility range for the wearer 110 and, yet, the shoulder pad system 100 may provide a high degree of protection for the wearer 110.

As shown in FIGS. 1, 5A, 5B, and 6, the protective outer covering 102 of the shoulder pad system 100 may further include additional armor members 106, such as a first arch stiffener 141 and a second arch stiffener 142 The first and second arch stiffeners 141, 142 may comprise unitary, one-piece contoured plates, or in other embodiments, the arch stiffeners 141, 142 may include the plurality of layers 182 as discussed above with reference to FIGS. 4A-4D.

The first arch stiffener 141 may layer over and may be fixedly attached to the arch body 168 of the first arch member 131 at the top end 125 of the shoulder pad system 100, and the second arch stiffener 142 may be fixedly attached similarly to the second arch member 132 at the top end 125 of the shoulder pad system 100. The first arch stiffener 141 may be attached (e.g., via rivets or other fasteners) over the arch body 168 on the outer side 108, and the second arch stiffener 142 may be attached (e.g., via rivets or other fasteners) over the second arch member 132 on the outer side 108. The first arch stiffener 141 and the second arch stiffener 142 may cooperatively define the neck opening 122 of the shoulder pad system 100. In some embodiments, the arch body 168 of the arch members 131, 132 may include a recess, a depression, an area of reduced thickness, etc. that corresponds, respectively, to the arch stiffeners 141, 142 such that the combined thickness of the arch body 168 and arch member 131 substantially matches the thickness at the surrounding areas of the arch members 131, 132.

The first arch stiffener 141 is shown in detail in FIGS. 5A, 5B, and 6 and specific features will be discussed according to exemplary embodiments. It will be appreciated that the second arch stiffener 142 may include similar and corresponding features. As shown, the first arch stiffener 141 may be a relatively thin, strong, lightweight resiliently flexible plate with a front edge 154, a back edge 156 (FIG. 6), an inner edge 158, and an outer edge 160. The first arch stiffener 141 may arcuately contour from the front edge 154 to the back edge 156. The first arch stiffener 141 may attach over the arch body 168 with the front edge 154 at the front side 127 of the shoulder pad system 100, the back edge 156 at the back side 128, the inner edge 158 disposed at the neck opening 122 proximate the axis 101, and the outer edge 160 disposed proximate at the lateral side 129 further away from the axis 101. Also, as shown in FIG. 6, the first arch stiffener 141 may include an exterior surface 162 that faces outward to define part of the outer side 108 of the shoulder pad system 100, and the first arch stiffener 141 may include an interior surface 164 that faces inwardly toward the first arch member 131. The thickness of the first arch stiffener 141 may be measured between the exterior surface 162 and the interior surface 164, and this thickness may be substantially constant across a majority of the first arch stiffener 141.

In some embodiments, the first arch stiffener 141 may include a first stiffening rib 143 and a second stiffening rib 145. The first stiffening rib 143 may project upward and outward from the exterior surface 162 and may arcuately extend continuously from the front edge 154, across the top end 125, to the back edge 156. As shown in FIG. 6, the second stiffening rib 145 may also extend longitudinally from the front edge 154 to the back edge 156. The second stiffening rib 145 may include an upper surface 177 (FIGS. 5B and 6) that is proximate the outer edge 160 of the arch stiffener 141. The first stiffening rib 143 and the second stiffening rib 145 may be spaced apart at a distance along the third axis 105. The first and second stiffening ribs 143, 145 may increase stiffness and limit bending of the first arch member 131 for protecting the wearer 110. Also, the stiffening ribs 143, 145 may be highly manufacturable with little effect on part count or weight of the shoulder pad system 100.

It will be appreciated that the second arch stiffener 142 may be substantially similar to the first arch stiffener 141. The second arch stiffener 142 may be symmetrical to the first arch stiffener 141.

Still further, the protective outer covering 102 of the shoulder pad system 100 may further include additional armor members 106, such as a first epaulette 191 and a second epaulette 192. The first and second epaulettes 191, 192 may be substantially similar and may be symmetrically disposed on opposite sides of the neck opening 122.

The first epaulette 191 is discussed in detail, and it will be appreciated that the second epaulette 192 may include similar features. The first epaulette 191 may be a three-dimensionally contoured plate (e.g., a shallow bowl-shaped pad) that is moveably attached by an epaulette coupling 146 to the first arch stiffener 141 at the top end 125 of the shoulder pad system 100. The first epaulette 191 may comprise a unitary, one-piece contoured plate, or in other embodiments, the epaulette 191 may include the plurality of layers 182 as discussed above with reference to FIGS. 4A-4D.

The first epaulette 191 may include an outer peripheral edge 193 that extends about the outer shoulder area 112 of the wearer 110. Also, the epaulette 191 may include a flat projection 194 that projects from the outer peripheral edge 193 and that is coupled to the first arch stiffener 141 (and/or the arch body 168) via the epaulette coupling 146. The flat projection 194 may be integral with the first epaulette and may be substantially rigid and resistant to bending.

Figure 5B:
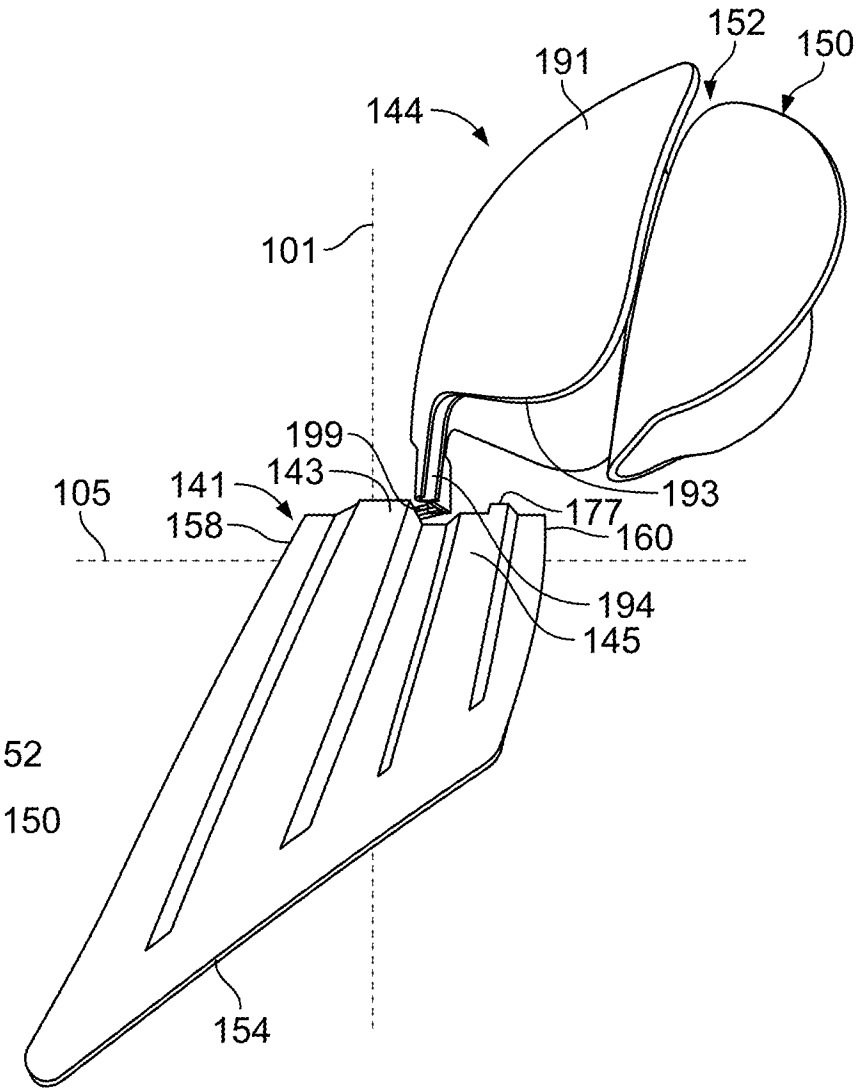
FIGS. 5A and 5B are front views of an arch stiffener and an epaulette of the shoulder pad system of FIG. 1 shown in a first position and a second position, respectively, according to exemplary embodiments.
Figure 5A:
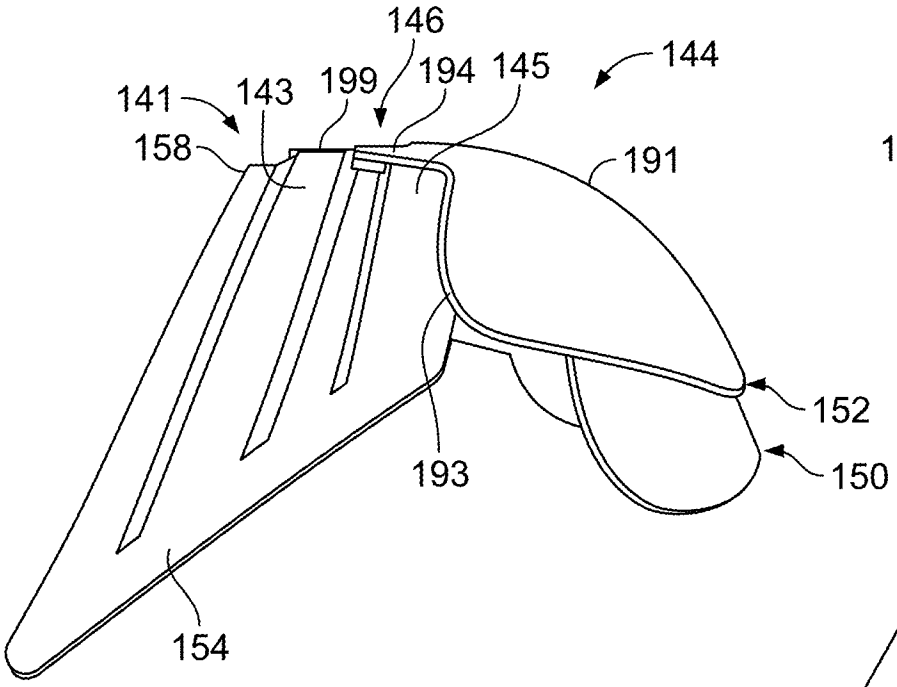
Figure 6:
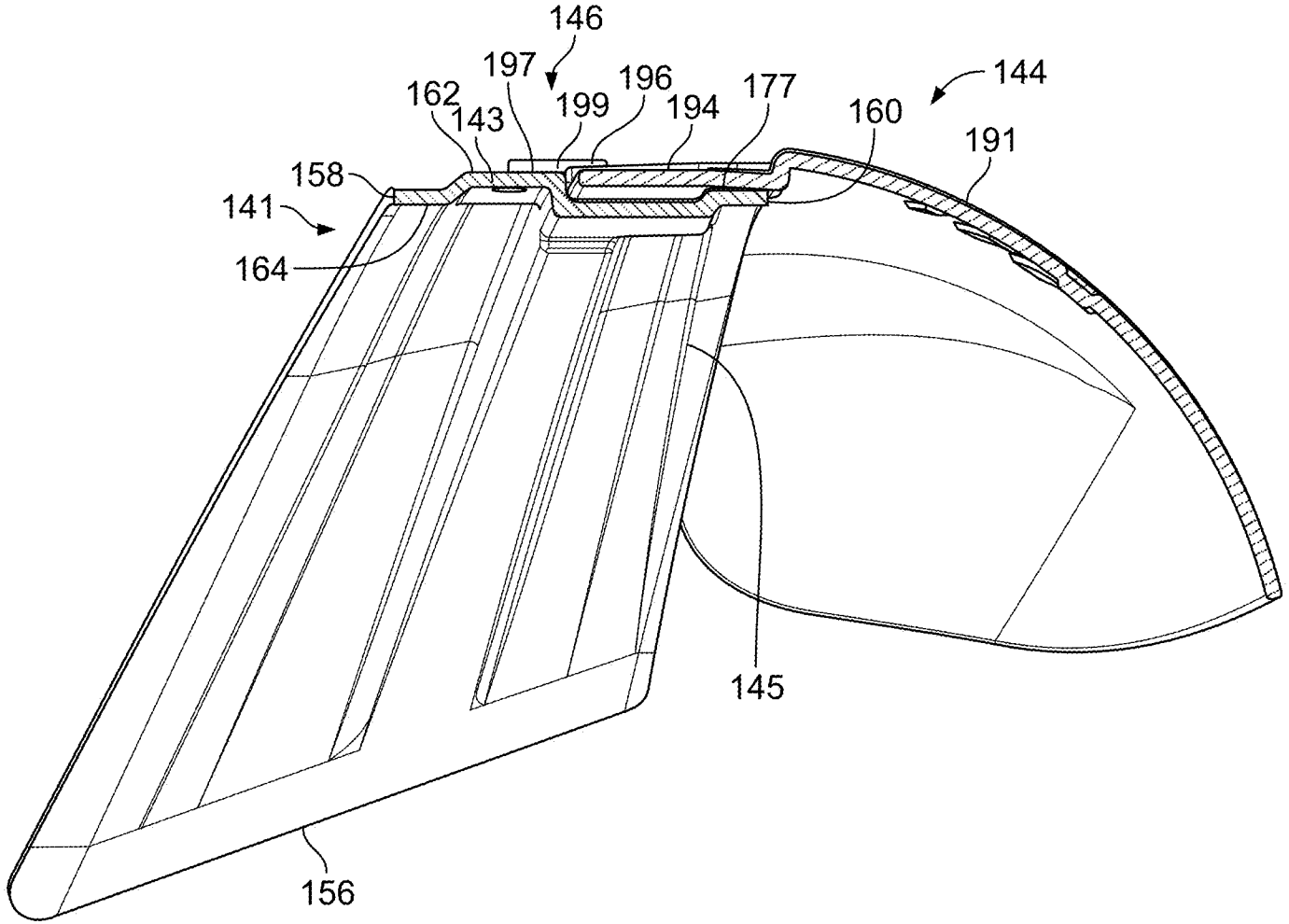
FIG. 6 is a cross-sectional view of the arch stiffener and epaulette of FIGS. 5A and 5B.

As shown in FIGS. 5A, 5B, and 6, the epaulette coupling 146 may include a flexible strap 199 (i.e., band, web, strong fabric or polymer sheet/tape, or other similar coupling) that is fixed at a first side attachment 196 to the projection 194 of the epaulette 191 and at a second side attachment 197 to the arch stiffener 141 (and/or the arch boy 168). In some embodiments, the first side attachment 196 and/or the second side attachment 197 is a fixed point attachment, such as a rivet, or other fastener.

The terminal end of the projection 194 may be moveably coupled (e.g., rotationally coupled, etc.) to the arch stiffener 141 via the strap 199 for movement between a first position (FIGS. 1, 5A, and 6) and a second position (FIG. 5B). In the first position, the projection 194 and the a portion of the outer peripheral edge 193 may overlie, lie substantially flat against, overlap, engage, abut, and/or nest over the outer edge 160 of the first epaulette 191. In some embodiments, the second stiffening rib 145 may be interrupted and discontinuous between the front edge to the back edge. The epaulette 191 may include a recess, etc. for receiving the projection 194 when in the first position. In the second position, the epaulette 191 may be rotated upward (about the second axis 103), thereby allowing the wearer 110 to raise the arm 118 with little limitation.

Figure 7:
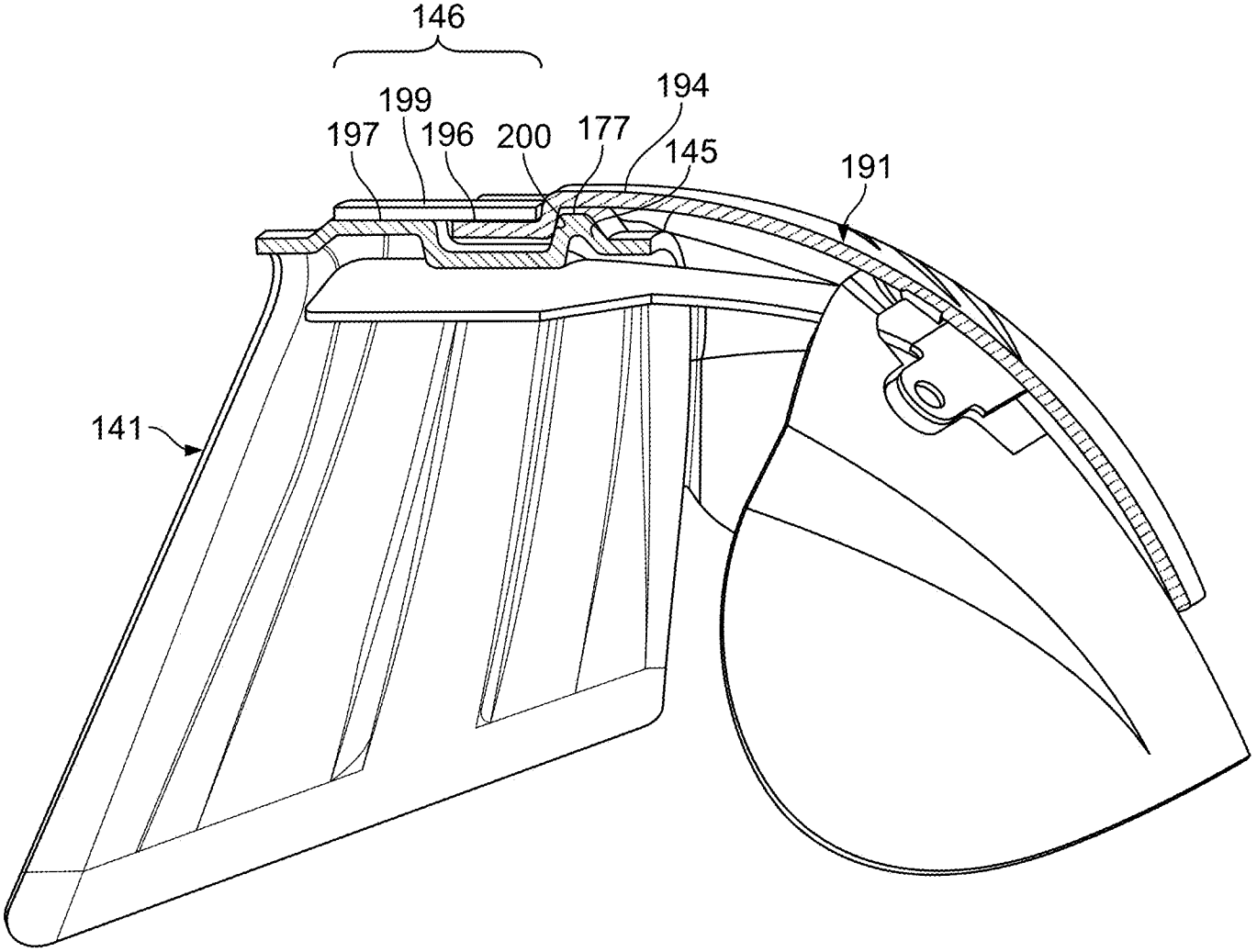
FIG. 7 is a cross-sectional view of the arch stiffener and epaulette of FIGS. 5A and 5B according to additional exemplary embodiments.

Also, in the first position, the upper surface 177 of the second stiffening rib 145 may abut against the projection 194 of the first epaulette 191 to limit rotation of the first epaulette downward. The increased stiffening provided by the rib 145 may robustly support the first epaulette 191 to improve protection for the wearer 110. In additional embodiments represented in FIG. 7, the projection 194 may include a stepped inner surface 200 that may abut against and robustly engage the second stiffening rib 145 at the inner edge of the upper surface 177 of the second stiffening rib 145. This engagement may protect the wearer 110, for example, when a downward impact load is applied to the epaulette 191 at the first lateral side 129 of the shoulder pad system 100.

Figure 8A:
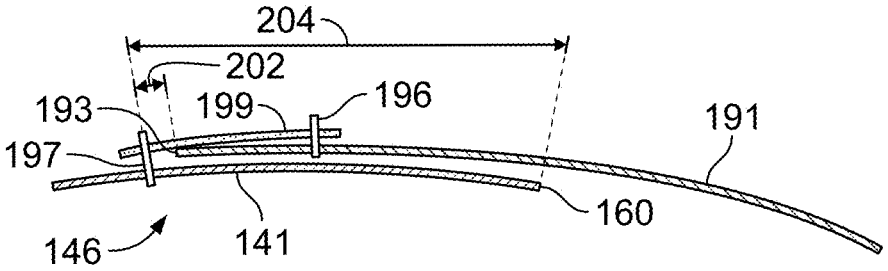
FIGS. 8A and 8B are schematic views of the arch stiffener and epaulette of FIGS. 5A and 5B in a first position and a second position, respectively, according to exemplary embodiments.
Figure 8B:
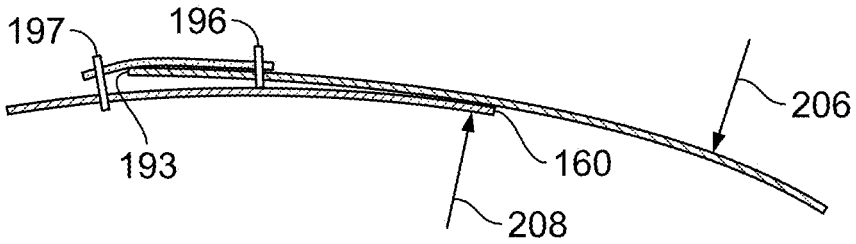

Furthermore, the epaulette coupling 146 may provide further support and protection as illustrated schematically in FIGS. 8A and 8B. As shown, the shoulder pad system 100 may define a first coupling length 202 measured (along the third axis 105) from the second side attachment 197 to the outer peripheral edge 193 of the epaulette 191. The shoulder pad system 100 may also define a second coupling length 204 measured (along the third axis 105) from the second side attachment 197 to the outer edge 159 of the arch stiffener 141. The epaulette coupling 146 may be arranged such that the second coupling length 204 is at least 3.5 times the first coupling length 202. Accordingly, if a downwardly-directly impact load (represented by arrow 206) is applied to epaulette 191, there may be a reaction load (represented by arrow 208) where the edge 160 pushes against the underside of the epaulette 191, and the strap 199 may remain substantially flat across the coupling 146. Thus, the epaulette 191 may nest against the arch stiffener 141 in the first position and may be limited against rotation against the body of the wearer 110.

Figure 9A:
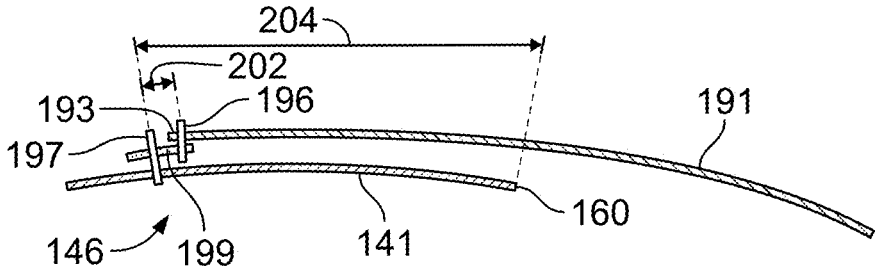
FIGS. 9A and 9B are schematic views of the arch stiffener and epaulette of FIGS. 5A and 5B in a first position and a second position, respectively, according to additional exemplary embodiments.
Figure 9B:
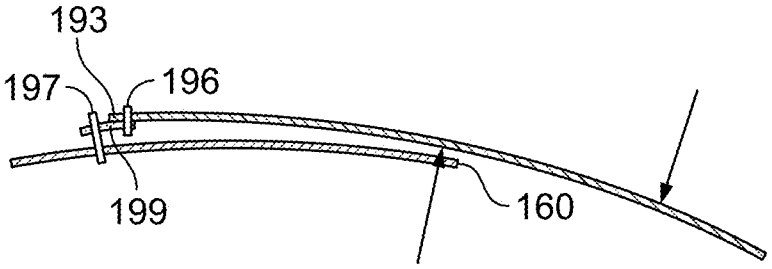

In additional embodiments represented in FIGS. 9A and 9B, the coupling 146 may be substantially similar to the embodiments of FIGS. 8A and 8B. However, the strap 199 may be layered between the epaulette 191 and the arch stiffener 141. In these embodiments, the second length 204 may be at least 3.5 times the first length 202. Again, this arrangement may provide robust support for the epaulette 191, limiting rotation toward the wearer 110. However, the epaulette 191 may allow a high range of rotational motion upward (e.g., similar to FIG. 5B) toward the second position to allow the wearer 110 to raise the arms 118 with little limitation.

Figure 10:
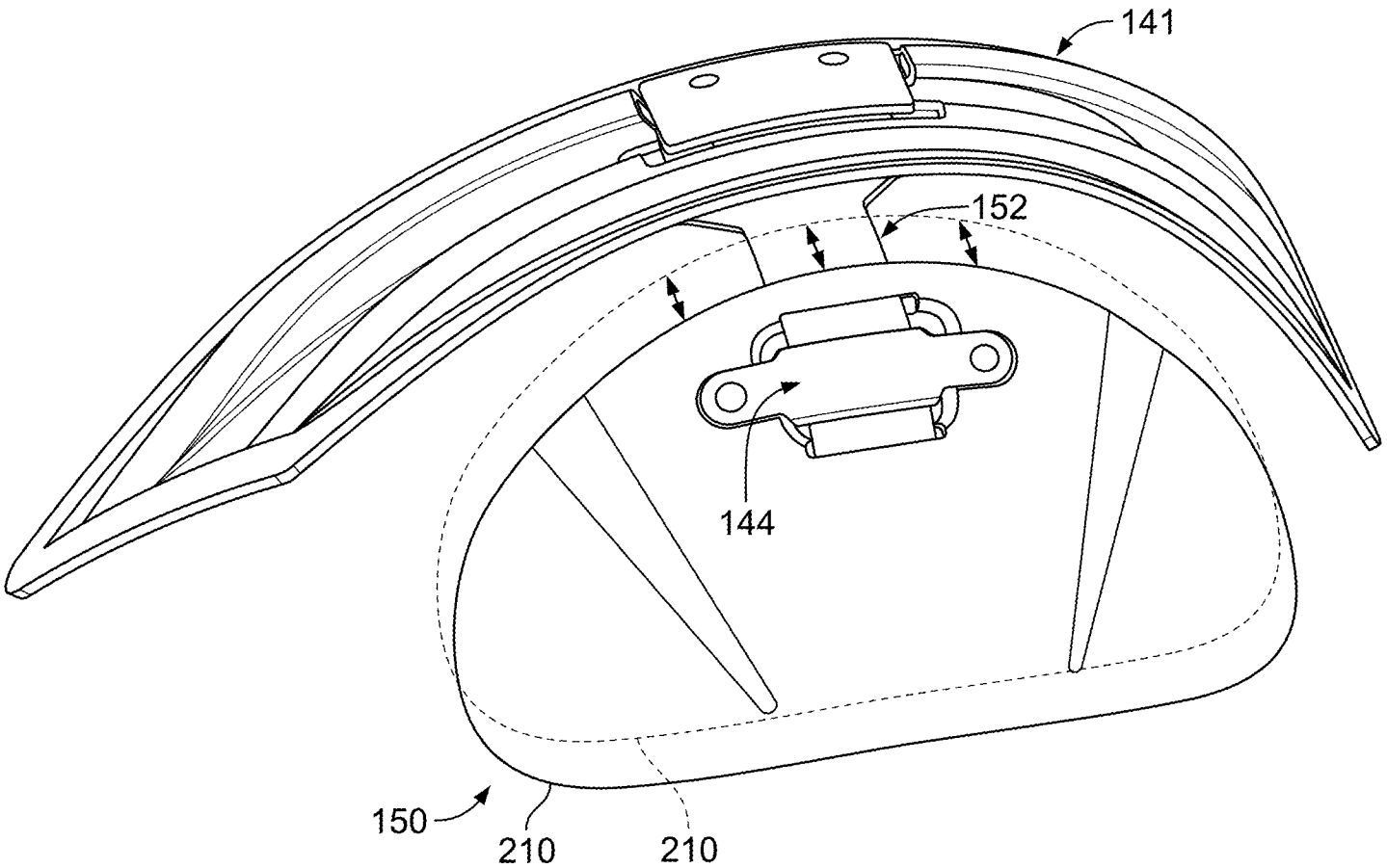
FIG. 10 is a side view of a shoulder cap and arch stiffener of the shoulder pad system according to exemplary embodiments.

The protective outer covering 102 of the shoulder pad system 100 may further include additional armor members 106, such as a shoulder cap 150. The shoulder cap 150 may comprise a unitary, one-piece contoured plate, or in other embodiments, the cap 150 may include the plurality of layers 182 as discussed above with reference to FIGS. 4A-4D. As shown in FIG. 1, there may be a shoulder cap 150 for each lateral side 129, 130 of the shoulder pad system 100. As shown in FIGS. 1 and 10, the shoulder cap 150 may be a three-dimensionally contoured plate (e.g., a shallow bowl-shaped member) configured to cover over the outer and lower portions of the shoulder areas 112. The shoulder cap 150 may include an outer peripheral edge 210.

As shown in FIGS. 2 and 10, the shoulder cap 150 may be coupled via a cap coupling 152 to the underside of the first arch stiffener 141. The cap coupling 152 may be a flexible strap (e.g., tape, fabric belt, polymeric tape, or other similar coupling) that may be joined to the underside of the first arch stiffener 141 via one or more rivets. As such, the shoulder cap 150 may be suspended from the arch stiffener 141. Also, in some embodiments, the cap coupling 152 may be adjustable for selectively changing the position of the cap 150 relative to the arch stiffener 141. For example, the cap coupling 152 may include a clamp 144. The clamp 144 may be moved between a tightened position, in which the shoulder cap 150 is disposed at a fixed length away from the arch stiffener 141, and a loosened position, in which the cap 150 may be selectively shifted toward or away from the arch stiffener 141. A first position of the shoulder cap 150 relative to the stiffener 141 is shown in solid lines in FIG. 10, and a second position of the cap 150 is shown in phantom lines. In the second position, the outer peripheral edge 210 is shown closer to the arch stiffener 141 in FIG. 10. It will be appreciated that the clamp 144 may allow for selective adjustment between a range of positions. Thus, the shoulder cap 150 may be selectively adjusted, for example, according to the particular anatomical measurements of the wearer 110. The shoulder cap 150 may be easily and conveniently adjusted to fit properly on the particular wearer 110.

The shoulder pad system 100 may further include an underarm adjustable fitting system 220 as shown in FIGS. 1, 11, 12A, and 12B. The adjustable fitting system 220 may include a first underarm strap member 221 that extends under the arm 118 of the wearer 110 to attach to the lower chest plate 166 and to the back side 128 of the first arch member 131. There may be a similar and corresponding second underarm strap member 223 that extends under the other arm 118 to attach between the front side 127 and the back side 128 of the second arch member 132.

Figure 11:
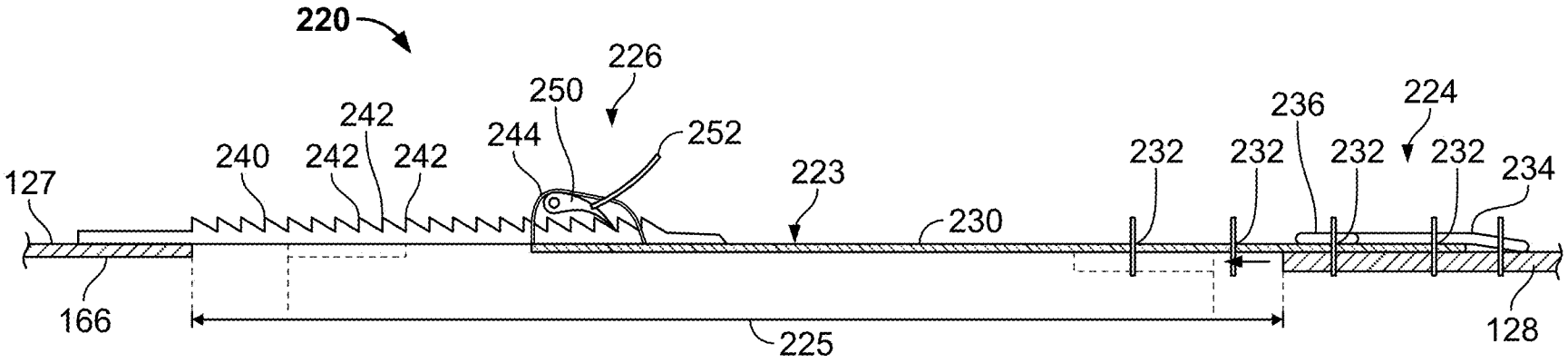
FIG. 11 is a schematic view of an underarm securement of the shoulder pad system of FIG. 1 according to exemplary embodiments.
Figure 12A:
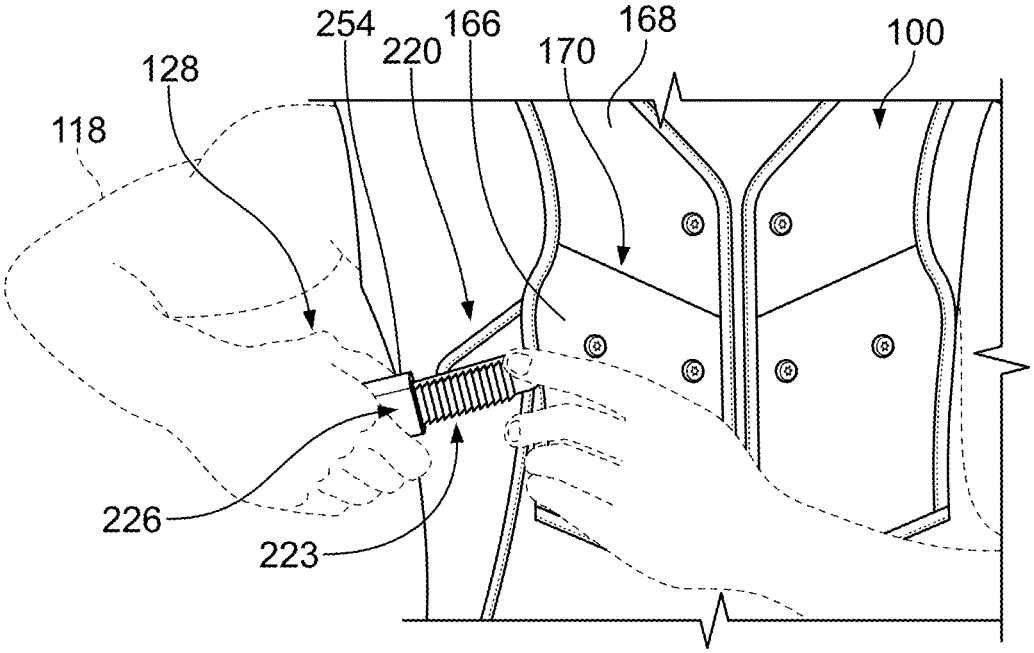
FIGS. 12A and 12B is a front view of the shoulder pad system of FIG. 1 with the underarm securement of FIG. 11 in a first position and a second position, respectively.
Figure 12B:
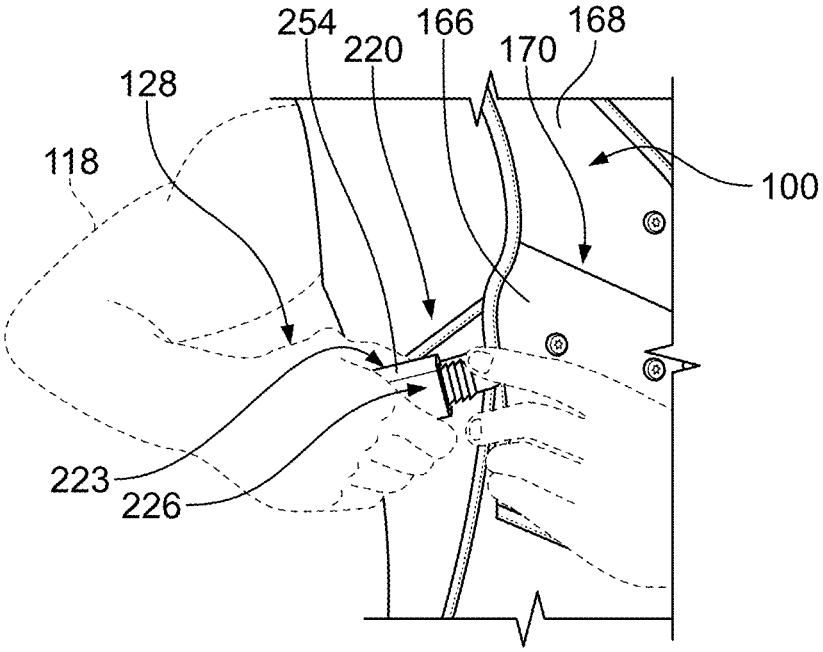

FIGS. 11, 12A, and 12B show the second underarm strap member 223 in detail, and it will be appreciated that the first underarm strap member 221 may include similar and corresponding features. The second underarm strap member 223 may include one or more polymeric strips, fabric belts, or other similar couplings. The second underarm strap member 223 may include a first adjustable coupling 224 and a second adjustable coupling 226. Both adjustable couplings 226 may be used independent of the other to adjust tension, tightness, etc. of the strap member 223 and to change a fit, tightness of the arch member 132 under the arm 118 of the wearer 110. The second adjustable coupling 226 may be disposed closer to the front side 127 than the first adjustable coupling 224, making the second adjustable coupling 226 convenient to grasp and manipulate, for example, while wearing the shoulder pad system 100.

In some embodiments, the strap member 223 may include a first support strap 230 with a plurality (e.g., at least three) eyelets 232. The strap member 223 may also include a corresponding first attachment strap 234 that is attached (e.g., via a rivet) at one end to the back side 128 of the arch member 131 and that includes a buckle 236 at the opposite (free) end. The first attachment strap 234 may be fixed close to and proximate the intersection of the back bottom edge 148 and the outer edge 151. To define the first adjustable coupling 224, the buckle 236 may releasably attach (i.e., buckle) to one of the eyelets 232. There may be four eyelets 232 spaced apart as shown in the illustrated embodiments of FIG. 11. The eyelets 232 may be spaced apart approximately 0.25 inches apart or more in some embodiments. Thus, a distance 225 between the lower chest plate 166 and the back side 128 of the arch member 131 (and/or tension in the strap member 223) may be selectively adjusted between four positions according to the illustrated embodiments. However, it will be appreciated that there may be more or less than four set positions for the adjustable coupling 224. It will be appreciated that the first adjustable coupling 224 may be referred to as a "rough" adjust in comparison with the second adjustable coupling 226 because it has comparatively fewer set positions. Furthermore, in additional embodiments, the first adjustable coupling 224 may comprise a strap clamp or other features.

The strap member 223 may further include a ribbed strap 240 that is fixedly attached to the lower chest plate 166 (e.g., via a rivet) close to and proximate the intersection between the front bottom edge 147 and the outer edge 151. The ribbed strap 240 may be fixed to the lower chest plate 166 between the first chest strap 137 and the second chest strap 138 (along the first axis 101). The ribbed strap 240 may also include a sawtooth profile, a plurality of ridges, or other series of projections 242 that are spaced equally along the length thereof on one side. The ribbed strap 240 may be made of a strong, slightly flexible polymeric material. The support strap 230 may include a quick-release clamp 244 mounted thereon that is configured to releasably engage with the ribbed strap 240. The clamp 244 may include a ratchet tooth 250 therein that may selectively engage with the projections 242. To define the second adjustable coupling 226, the ribbed strap 240 may be received in the clamp 244, and the ratchet tooth 250 may engage a selected one of the projections 242 and interfere with the ribbed strap 240 backing out of the clamp 244. The second adjustable coupling 226 may further include a release member 252, such as a short strap or pull-tab. The wearer 110 may pull the release member 252 to move the ratchet tooth 250 out of engagement from the ribbed strap 240 for releasing and loosening the strap member 223. The second adjustable coupling 226 may be referred to as a "fine" adjust in comparison with the first adjustable coupling 224 because the second adjustable coupling 226 has comparatively more set positions. Thus, the shoulder pad system 100 provides both the first and second adjustable couplings 224, 226 for conveniently adjusting and tailoring the fit to the particular body dimensions and preferences of the wearer 110. Also, the second adjustable coupling 226 may be quickly and conveniently disengaged by pulling the release member 252.

In some embodiments, the shoulder pad system 100 may further include a handle member 254 (FIGS. 12A, 12B). The handle member 254 may be a hollow, box-shaped sleeve that covers over the second adjustable coupling 226. The handle member 254 may be configured for grasping with one hand and the ribbed strap 240 with the other when inserting the ribbed strap into the clamp 244 (i.e., when tightening the second adjustable coupling 226). The handle member 254 may also include an opening for the release member 252 to extend outward therefrom. Thus, the release member 252 may be pulled away from the handle member 254 to loosen and release the second adjustable coupling 226.

Figure 13A:
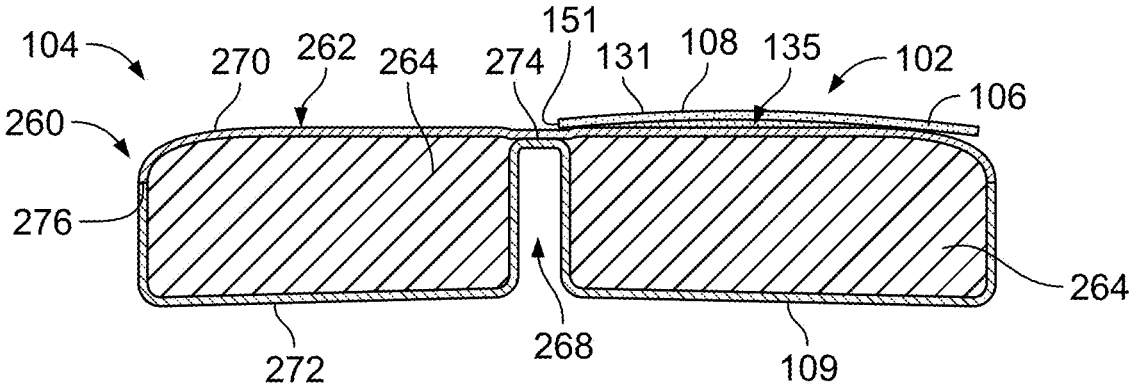
FIGS. 13A, 13B, and 13C are cross sectional views of a cushion member of the shoulder pad system of FIG. 1 according to various embodiments.

Referring now to FIGS. 2 and 13A, the cushioning system 104 will be discussed in greater detail. The cushioning system 104 may comprise one or more resiliently compressible cushioning members 260. As shown in FIG. 13A, an exemplary cushioning member 260 may include an outer skin layer 262 and at least one cushion support member 264 that is encapsulated therein. The outer skin layer 262 may include a first sheet 270 and a second sheet 272 that are layered and joined at a peripheral seam 276 of the cushioning member 260 and that are separated at other areas to define one or more chambers for encapsulating the interior cushion support member 264 therebetween. Also, the first sheet 270 and the second sheet 272 may be joined at a hinge 274 between neighboring cushion support members 264. As shown in FIG. 13A, a channel 268 may be defined on at least one side of the hinge 274. As shown in the embodiments of FIG. 13A, the first sheet 270 and the second sheet 272 may be joined substantially at or proximate the outer side 108 of the shoulder pad system 100. Thus, the channel 268 may be open toward the interior of the shoulder pad system 100.

The skin layer 262 may be a thermoplastic polymer, and the first sheet 270 and the second sheet 272 may be joined at the peripheral seam 276 and the hinge 274 via plastic thermal welding, via adhesives, etc. At least one of the first sheet 270 and the second sheet 272 may be shaped (e.g., via thermoforming process) to define a contoured pocket that is contoured according to the outer surface of the cushion support member 264 such that the cushion support member 264 may be nested therein. In some embodiments represented in FIG. 13A, the second sheet 272 may be shaped as a tray using a thermoforming process, and the two cushion support members 264 shown may be held and nested within the shaped second sheet 272 and encapsulated as the first sheet 270 is layered over and joined to the second sheet 272. Accordingly, the cushioning support members 264 may be encapsulated with the hinge 274 defined therebetween and the peripheral seam 276 encompassing the cushioning member 260. The hinge 274 may be a so-called "living hinge" that is integrally formed where the first and second sheets 270, 272 are joined.

The cushion support member 264 made be constructed from, include, or comprise a highly compressible, energy absorbing, and/or resilient material. The cushion support member 264 may be or include a foam material (e.g., a block of foam with a predetermined durometer). The cushion support member 264 may be or include a compressible gel, liquid, or fluid. The cushion support member 264 may be or include a bladder that contains air, gel, or liquid.

Furthermore, in some embodiments, the cushioning members 260 may be at least partly additively manufactured (e.g., three-dimensionally printed, etc.). In some embodiments, the cushion support member 264 may be additively manufactured and may include a lattice structure or other shaped geometry for providing cushioned support. The first sheet 270 and/or the second sheet 272 of the outer skin layer 262 may, in some embodiments, be additively manufactured in a single additive manufacturing process with the cushion support member 264. In other embodiments, the cushion support member 264 may be additively manufactured, and the first sheet 270 and the second sheet 272 may be layered and thermoformed thereover in a subsequent process.

Figure 13B:
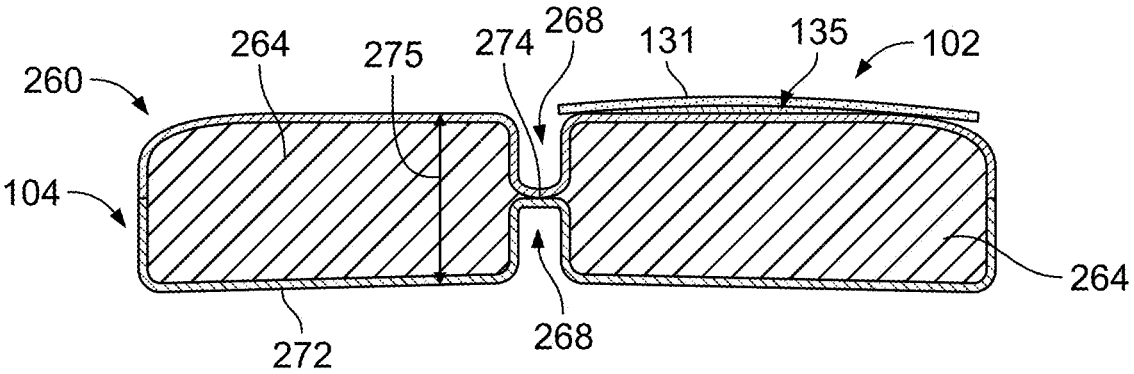

In additional embodiments of FIG. 13B, the cushioning member 260 may be substantially similar to those of FIG. 13A. However, the first sheet 270 and the second sheet 272 may be joined substantially at a midpoint between a thickness 275 of the cushioning member 260. Accordingly, there may be substantially equally-sized channels 268 on both sides of the hinge 274.

Figure 13C:
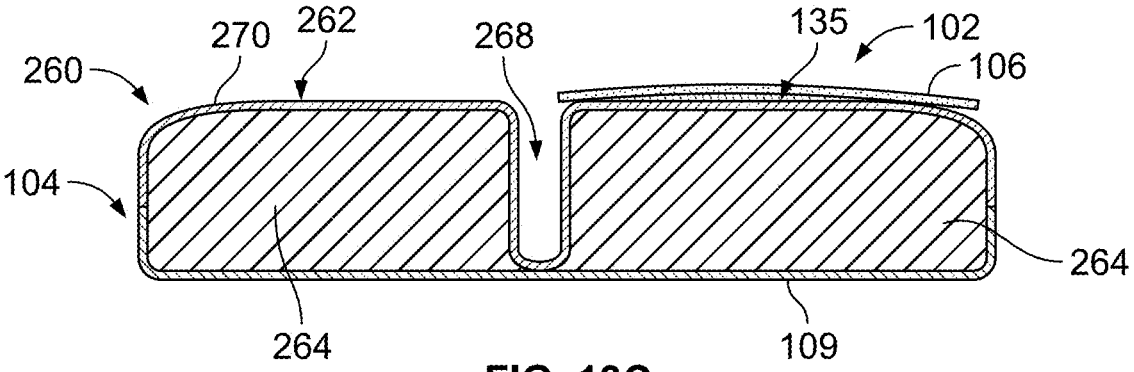

Additionally, in embodiments of FIG. 13C, the cushioning member 260 may be substantially similar to those of FIGS. 13A and 13B. However, the first sheet 270 and the second sheet 272 may be joined substantially at the inner side 109. Accordingly, the channel 268 may be open toward the outer side 108 of the shoulder pad system 100.

As shown in FIG. 2, the cushioning system 104 may include a plurality of cushioning members 260 of various sizes and shapes. Those of the first arch member 131 are shown exploded therefrom. Corresponding cushioning members 260 of the second arch member 132 are shown attached. As shown, the cushioning members 260 may have various polygonal shapes (e.g., quadrilateral, wedge-shaped, or otherwise). As shown, the majority (e.g., all but two) of the members 260 of the system 104 may include at least two cushion support members 264 with respective hinges 268 disposed therebetween. Also, as shown in FIGS. 1 and 2, the first arch member 131 may include a single cushioning member 260 that covers and spans approximately from the front bottom edge 147 approximately to the area underneath the front edge 154 of the arch stiffener 141 to cover over the chest area 114 of the wearer 110. Likewise, in some embodiments, the first arch member 131 may include a single cushioning member 260 that covers and spans approximately from the back bottom edge 148 to span along the upper back area 116. The second arch member 132 may have similar cushioning members 260. At the more contoured areas of the inner side 109 of the top end 125, the cushioning system 104 may include a plurality of smaller cushioning members 260 that are assembled and arranged to fit and nest for comfortably cushioning the shoulder area 112 of the wearer 110. Some cushioning members 260 may be configured to define a flange that extends and projects outward from the outer edge 151 to provide cushioning between the epaulettes 191, 192 and the wearer 110 and/or between the shoulder caps 150 and the wearer 110. Moreover, the cushioning members 260 may provide cushioning for the wearer 110 from fasteners (e.g., rivets), areas of the adjustable fitting system 220 and/or other features of the shoulder pad system 100.

When assembled and attached on the interior surface 163, the cushioning members 260 may cover over and/or define a majority of the inner side 109 of the shoulder pad system 100. A majority of the cushioning members 260 may include a hinge 268, allowing the cushioning members 260 to be easily bent and folded into a position on the contoured interior surface 163. The cushioning members 260 may fit into a wide number of positions to tailor to a particular wearer 110 and/or to adjust to the armor members 106 as they are re-positioned to fit a particular wearer 110. Also, the outer covering 102 of the shoulder pad system 100 may be configured to resiliently flex in a predetermined fashion for protecting the wearer 110, and the armor members 106 may flex largely unconstrained by the plurality of cushioning members 260.

In some embodiments, the shoulder pad system 100 may include a fastening feature 135 for attaching the plurality of cushioning members 260 on the interior surface 163 of the shoulder pad system 100. In some embodiments, the fastening feature 135 may include hook-and-loop tape (e.g., VELCRO™ brand fastener tape). As shown in FIG. 13A, the fastening feature 135 may be partly included on the first arch member 131, and the fastening feature 135 may be partly included on the cushioning members 260. For example, the loop tape of a hook-and-loop tape may be included on the cushioning members 260 and the hook tape may be included on the first arch member 131, or vice versa. As shown in FIG. 2, some of the cushioning members 260 (e.g., those at the outer edge 151) may include flanges extending inward toward the neck opening 122, and these flanges may include hook and loop tape components for layering underneath others of the cushioning members 260.

It will be appreciated that other fastening features 135 may be included for attaching the cushioning system 104 to the protective outer covering 102. For example, snaps, fasteners, zippers, straps, or other couplings may be included. In some embodiments, the cushioning members 260 may attach, at least partly to the epaulettes 191, 192 and/or the shoulder caps 150.

Furthermore, such as those with hook-and-loop tape, the cushioning members 260 may be removeably attached at a number of different, adjustable locations across the interior surface 163. The cushioning members 260 may be pieced together across the arch members 131, 132 to cooperatively cover over and/or define the interior surface 163. As such, the arrangement and position of the cushioning members 260 of the cushioning system 104 may be modular and adjustable for conveniently tailoring to a particular wearer 110. As represented in FIG. 13A, for example, the cushioning member 260 may be positioned on the first arch member 131 such that the hinge 274 is substantially aligned or disposed proximate the outer edge 151 of the first arch member 131. As such the cushioning member 260 may pivot about the hinge 274 as well as the outer edge 151, for example, to cushion the wearer 110 against loads from the edge 151. It will be appreciated that the fastener feature 135 may allow the cushioning system 104 to be adjusted to accommodate adjustments of the armor members 106 of the outer covering 102. Also, the cushioning system 104 may be adjusted to provide high range of mobility for the wearer 110 (e.g., to enable the arms 118 to be raised, extended, rotated, etc. for catching or throwing motions).

Furthermore, the cushioning members 260 may layer over in close proximity to the body of the wearer 110. The channels 268 may provide flow channels for ventilating interior areas between the wearer 110 and the shoulder pad system 100. Accordingly, the cushioning members 260 may be configured to ventilate the shoulder pad system 100 and to cool the wearer 110.

Figure 14:
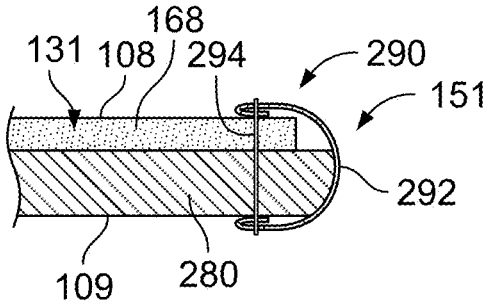
FIG. 14 is a cross sectional view of an edge finish feature of the shoulder pad system of FIG. 1 according to exemplary embodiments of the present disclosure.

As shown in FIGS. 14, the shoulder pad system 100 may further include one or more edge finish features 290 that cover over and define various edges thereof. In embodiments illustrated in FIG. 14, for example, the edge finish feature 290 may be included on the outer edge 151 of the first arch member 131. As shown, the outer edge 151 may be defined by the substantially rigid arch body 168 of the first arch member 131. Also, the first arch member 131 may include a pad 280 (e.g., a foam pad, textile padding, etc.) layered on the arch body 168 to define part of the inner side 109. The pad 280 may project outward further than the arch body 168 at the edge 151. Accordingly, the pad 280 may cover over the arch body 168 at the edge 151 to provide cushioning, and/or to absorb energy at the edge 151. Moreover, the edge finish feature 290 may include an edge binding 292 that wraps around the terminal edge of the arch body 168 and the raw edge of the arch pad 280. The edge binding 292 may be secured together with various stitch-and-turn finishing as shown, and raw edges may be folded into the seam before stitching. The edge binding 292 may be attached via a stitching 294 that passes through both the arch body 168 and the arch pad 280. The edge binding 292 may be constructed from and/or include water repellant material, a slightly stretchable material, etc. For example, the edge binding 292 may be made from and/or include a water repellant, slightly stretchable fabric.

Figure 15A:
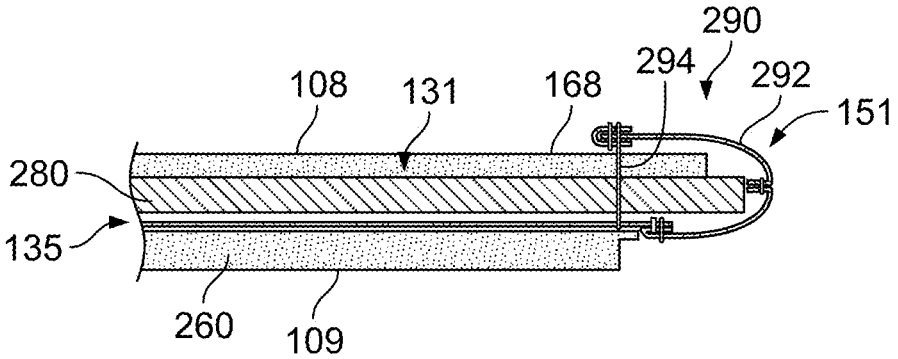
FIGS. 15A and 15B are cross sectional views of edge finish features of the shoulder pad system of FIG. 1 according to exemplary embodiments of the present disclosure.

Additionally, as shown in the embodiments of FIG. 15A, the first arch member 131 and the cushioning member 260 may be attached via the fastening feature 135 (e.g., hook-and-loop tape) at the edge 151 as discussed above. The arch pad 280 (e.g., a thin foam cushion) may be layered over the rigid arch body 168 of the first arch member 131 so as to be layered between the arch body 168 and the fastening feature 135. The arch pad 280 may extend and project from the terminal edges of the arch body 168. The edge binding 292 may wrap around the terminal edges arch body 168, the arch pad 280, and the raw edge of the fastening feature 135. The edge binding 292 may be attached via the stitching 294, which passes through the arch body 168, the arch pad 280, and the fastening feature 135.

Figure 15B:
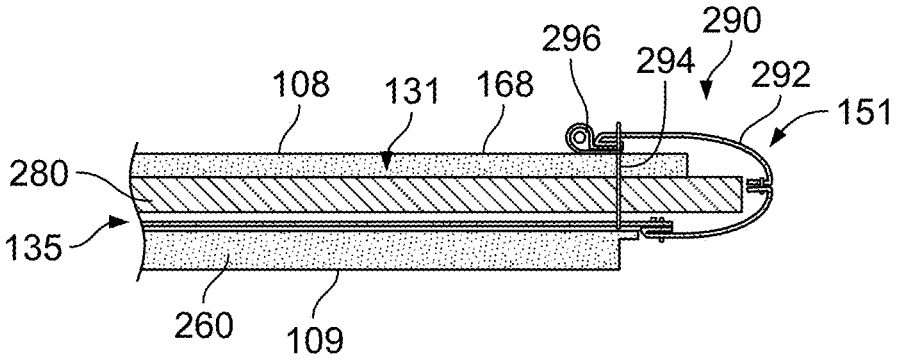

The shoulder pad system 100 may additionally or alternatively include the edge finish features 290 of FIG. 15B. As shown, the edge finish features 290 may be substantially similar to those of FIG. 15A; however, a piping stich 296 may be included at the outer side 108 at the armor member 106 for further securing the edge 151 with the rigid edge of the armor member 106 covered over and padded.

Accordingly, the shoulder pad system 100 may be comfortable, lightweight, and compact. The system 100 may also allow the wearer 110 to move substantially freely. The system 100 may also be highly adjustable for tailoring to a particular wearer 110, to adapt for a playing position, etc. Also, the shoulder pad system 100 provides a high level of protection for the wearer 110. Also, the shoulder pad system 100 provides significant manufacturing efficiencies, ease of assembly, low part count, etc. Also, the shoulder pad system 100 may provide ergonomic benefits.

In particular, the arch stiffeners 141, 142 may provide significant stiffness to the arch members 131, 131 and provide robust support for the arch members 131, 132, as well as the epaulettes 191, 192 and shoulder caps 150. The arch stiffeners 141, 142 may be lightweight. Also, these features may be highly manufacturable.

While at least one exemplary embodiment has been presented in the foregoing detailed description, it should be appreciated that a vast number of variations exist. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

What is claimed is:

1. A shoulder pad system configured for protecting a wearer comprising:

a cushioning system;

a protective outer covering with a plurality of armor members, the cushioning system supported within the protective outer covering and configured to be layered between the wearer and the protective outer covering;

the plurality of armor members including a first arch member and a second arch member that cooperatively define a neck opening for the wearer and that arch from a front side to a back side of the shoulder pad system;

the plurality of armor members including an arch stiffener that is layered over and attached to the first arch member, the arch stiffener being arched over the first arch member with a front edge of the arch stiffener disposed at the front side of the shoulder pad system and a back edge of the arch stiffener disposed at the back side of the shoulder pad system; and the arch stiffener including a stiffening rib that projects from the arch stiffener, the stiffening rib arching along the arch stiffener between the front side and the back side of the shoulder pad system.

2. The shoulder pad system of claim 1, wherein the stiffening rib is a first stiffening rib; and further comprising a second stiffening rib that projects from and arches along the arch stiffener from the front edge to the back edge.

3. The shoulder pad system of claim 1, wherein the stiffening rib arches continuously along the arch stiffener from the front edge to the back edge.

4. The shoulder pad system of claim 1, wherein the stiffening rib is discontinuous as the stiffening rib arches along the arch stiffener from the front edge to the back edge.

5. The shoulder pad system of claim 1, further comprising an epaulette that is moveably coupled to the arch stiffener for movement between a first position and a second position relative to the arch stiffener.

6. The shoulder pad system of claim 5, wherein the epaulette is moveably coupled for movement in a first direction away from the first position and toward the second position, wherein the epaulette is moveably coupled for movement in a second direction away from the second position and toward the first position, the second direction being opposite the first direction; and wherein the stiffening rib is configured to engage the epaulette and limit movement of the epaulette in the second direction.

7. The shoulder pad system of claim 6, wherein the stiffening rib is a first stiffening rib;

further comprising a second stiffening rib that projects from and arches along the arch stiffener from the front edge to the back edge, the second stiffening rib disposed closer to the neck opening than the first stiffening rib, the second stiffening rib having a top surface configured to engage the epaulette and limit movement of the epaulette in the second direction.

8. The shoulder pad system of claim 5, wherein the epaulette has a peripheral edge and the arch stiffener has an outer edge, wherein the epaulette is coupled to the arch stiffener by an epaulette coupling that extends between a first side attachment and a second side attachment, the first side attachment attaching the epaulette coupling to the arch stiffener, the second side attachment attaching the epaulette coupling to the epaulette, the outer peripheral edge overlapping the outer edge of the arch stiffener;

a first coupling length measured from the first side attachment to the peripheral edge;

a second coupling length measured from the first side attachment to the outer edge; and the second coupling length being at least 3.5 times the first coupling length.

9. The shoulder pad system of claim 8, wherein the peripheral edge of the epaulette is layered between the epaulette coupling and the outer edge arch stiffener.

10. The shoulder pad system of claim 8, wherein the epaulette coupling is layered between the peripheral edge and the outer edge of the arch stiffener.

11. The shoulder pad system of claim 1, further comprising a shoulder cap that is configured to cover an outer shoulder area of the wearer, the shoulder cap adjustably attached to the arch stiffener and having a first fixed position relative to the arch stiffener and a second fixed position relative to the arch stiffener.

12. The shoulder pad system of claim 11, wherein the shoulder cap is suspended from the arch stiffener.

13. The shoulder pad system of claim 1, wherein the arch stiffener comprises a plate with an inner edge and an outer edge that extend between the front edge and the back edge, the inner edge disposed proximate the neck opening, and the outer edge spaced away from the neck opening.

14. The shoulder pad system of claim 1, wherein the arch stiffener has a thickness measured between an interior surface and an exterior surface thereof, the interior surface facing the first arch member, and the exterior surface facing away from the first arch member; and wherein the thickness is substantially constant across a majority of the arch stiffener.

15. The shoulder pad system of claim 1, wherein the arch stiffener is a first arch stiffener; and wherein the plurality of armor members includes a second arch stiffener that arches and attaches over the second arch member, the second arch stiffener including a front edge disposed at the front side of the shoulder pad system and a back edge disposed at the back side of the shoulder pad system; and wherein the second arch stiffener includes a second stiffening rib that projects from the second arch stiffener, the second stiffening rib arching along the second arch stiffener between the front side and the back side of the shoulder pad system.

16. A method of manufacturing a shoulder pad system configured for protecting a wearer comprising:

providing a protective outer covering with a plurality of armor members, the protective outer covering configured to support a cushioning system therein for layering the cushioning system between the layer and the protective outer covering;

providing a first arch member of the plurality of armor members, the first arch member configured to attach to a second arch member of the plurality of armor members to cooperatively define a neck opening for the wearer, the first arch member arching from a front side to a back side of the shoulder pad system; and attaching an arch stiffener of the plurality of armor members to the first arch member, including layering the arch stiffener over the first arch member and arching the arch stiffener over the first arch member with a front edge of the arch stiffener disposed at the front side of the shoulder pad system and a back edge of the arch stiffener disposed at the back side of the shoulder pad system, the arch stiffener including a stiffening rib that projects from the arch stiffener, the stiffening rib arching along the arch stiffener between the front side and the back side.

17. A shoulder pad system configured for protecting a wearer comprising:

a cushioning system;

a protective outer covering with a plurality of armor members, the cushioning system supported within the protective outer covering and configured to be layered between the wearer and the protective outer covering;

the plurality of armor members including a first arch member and a second arch member that cooperatively define a neck opening for the wearer and that arch from a front side to a back side of the shoulder pad system;

the plurality of armor members including a first arch stiffener that is layered over and attached to the first arch member, the first arch stiffener being arched over the first arch member with a first front edge of the first arch stiffener disposed at the front side of the shoulder pad system and a first back edge of the first arch stiffener disposed at the back side of the shoulder pad system, the first arch stiffener including a first stiffening rib and a second stiffening rib that project from the first arch stiffener, the first stiffening rib and the second stiffening rib arching along the first arch stiffener between the front side and the back side;

an epaulette that is moveably coupled to the first arch stiffener for movement between a first position and a second position relative to the arch stiffener; and a shoulder cap that is configured to cover an outer shoulder area of the wearer and that is attached to the first arch stiffener.

18. The shoulder pad system of claim 17, wherein the shoulder cap is adjustably attached to the first arch stiffener and has a first fixed position relative to the first arch stiffener and a second fixed position relative to the first arch stiffener.

19. The shoulder pad system of claim 17, wherein the first arch stiffener has a thickness measured between an interior surface and an exterior surface thereof, the interior surface facing the first arch member, and the exterior surface facing away from the first arch member; and wherein the thickness is substantially constant across a majority of the first arch stiffener.

20. The shoulder pad system of claim 17, wherein the plurality of armor members includes a second arch stiffener that arches and attaches over the second arch member, the second arch stiffener including a second front edge disposed at the front side of the shoulder pad system and a second back edge disposed at the back side of the shoulder pad system; and wherein the second arch stiffener includes a third stiffening rib and a fourth stiffening rib that project from the second arch stiffener, the third stiffening rib and the fourth stiffening rib arching along the second arch stiffener between the front side and the back side of the shoulder pad system.

* * * * *